US008038247B2

(12) United States Patent
Yamaguchi et al.

(10) Patent No.: US 8,038,247 B2
(45) Date of Patent: Oct. 18, 2011

(54) RECORDING APPARATUS AND RECORDING METHOD

(75) Inventors: Hiromitsu Yamaguchi, Yokohama (JP); Tsuyoshi Shibata, Yokohama (JP); Takashi Ochiai, Machida (JP); Eri Noguchi, Yokohama (JP); Makoto Akahira, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 214 days.

(21) Appl. No.: 12/362,338

(22) Filed: Jan. 29, 2009

(65) Prior Publication Data

US 2009/0189934 A1 Jul. 30, 2009

(30) Foreign Application Priority Data

Jan. 29, 2008 (JP) ..... 2008-017839

(51) Int. Cl.
*B41J 2/205* (2006.01)

(52) U.S. Cl. ..... 347/15; 347/41

(58) Field of Classification Search ..... 347/41, 347/12, 15, 40, 43; 358/1.2, 1.9
See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 7,429,094 | B2 * | 9/2008 | Hamasaki et al. | 347/41 |
| 2001/0017638 | A1 * | 8/2001 | Otsuki | 347/41 |
| 2003/0025757 | A1 * | 2/2003 | Shioya et al. | 347/41 |

FOREIGN PATENT DOCUMENTS

| | | |
|---|---|---|
| JP | 54-56847 | 8/1979 |
| JP | 59-123670 | 7/1984 |
| JP | 59-138461 | 8/1984 |
| JP | 60-71260 | 4/1985 |
| JP | 8-156258 | 6/1996 |

* cited by examiner

*Primary Examiner* — Lamson Nguyen
(74) *Attorney, Agent, or Firm* — Canon USA Inc. IP Division

(57) ABSTRACT

A recording apparatus for recording an image on a recording medium by scanning the recording medium with a recording head for discharging ink includes a thinning unit configured to thin data for discharging ink by the recording head on a plurality of areas formed by dividing scanning regions including at least a first scanning region and a second scanning region to be recorded each by one scan of the recording head in the scan direction, and a recording head drive unit configured to discharge ink by driving the recording head based on data which has been thinned by the thinning unit, wherein a boundary between the areas in the first scanning region is located in a different position from that of a boundary between areas in the second scanning region, which is adjacent to the first scanning region, in the scan direction.

8 Claims, 16 Drawing Sheets

FIG.10A

| RECORDING DATA (ORIGINAL DATA) | COUNTER VALUE |
|---|---|
| ○×○○○×○××××○○× | 0 1 1 1 0 1 1 1 |

FIG.10B

FIRST RECORDING DATA

| BEFORE PROCESSING | COUNTER VALUE |
|---|---|
| **○**×○○○×○××××○○× | **0** 1 1 1 0 1 1 1 |

| AFTER PROCESSING | COUNTER VALUE |
|---|---|
| **×**×○○○×○××××○○× | 1 1 1 0 1 1 1 **0** |

FIG.10C

SECOND RECORDING DATA

| BEFORE PROCESSING | COUNTER VALUE |
|---|---|
| ×**×**○○○×○××××○○× | 1 **1** 1 0 1 1 1 0 |

| AFTER PROCESSING | COUNTER VALUE |
|---|---|
| ×**×**○○○×○××××○○× | 1 1 1 0 1 1 1 0 |

FIG.10D

SMS THINNING PROCESSING RESULTS

ORIGINAL DATA

○×○○○×○××××○○×

PROCESSED DATA

××○○○××××××○○×

FIG.12

2401

BEFORE DATA CHANGE

| | | | | | | | |
|---|---|---|---|---|---|---|---|
| 10 | 10 | 9 | 3 | 0 | 0 | 1 | 8 |
| 12 | 9 | 8 | 10 | 12 | 9 | 6 | 11 |
| 11 | 6 | 5 | 11 | 10 | 15 | 5 | 0 |
| 9 | 7 | 3 | 2 | 9 | 14 | 12 | 0 |
| 4 | 3 | 0 | 1 | 8 | 10 | 5 | 3 |
| 1 | 6 | 9 | 6 | 11 | 9 | 8 | 2 |
| 0 | 4 | 8 | 5 | 0 | 0 | 1 | 5 |
| 0 | 1 | 8 | 9 | 7 | 3 | 2 | 4 |

300 dpi × 300 dpi
64 PIXELS (4 BITS)

GRADATION VALUE
INTEGRAL: 380

CORRECTION AMOUNT: 30

2402

AFTER DATA CHANGE

| | | | | | | | |
|---|---|---|---|---|---|---|---|
| 9 | 9 | 8 | 3 | 0 | 0 | 1 | 7 |
| 11 | 8 | 7 | 9 | 11 | 8 | 6 | 10 |
| 10 | 6 | 5 | 10 | 9 | 14 | 5 | 0 |
| 8 | 6 | 3 | 2 | 8 | 13 | 11 | 0 |
| 4 | 3 | 0 | 1 | 7 | 9 | 5 | 3 |
| 1 | 6 | 8 | 6 | 10 | 9 | 7 | 2 |
| 0 | 4 | 7 | 5 | 0 | 0 | 1 | 5 |
| 0 | 1 | 7 | 8 | 6 | 3 | 2 | 4 |

300 dpi × 300 dpi
64 PIXELS (4 BITS)

GRADATION VALUE
INTEGRAL: 350

RECORDING APPARATUS AND RECORDING METHOD

BACKGROUND OF THE INVENTION

1. Field of the Invention

The present invention relates to a recording apparatus and a recording method, more specifically, recording an image using a recording head for discharging ink.

2. Description of the Related Art

An inkjet recording system printer records an image on a recording medium by scanning a recording head, which discharges ink based on recording data of the image, in a direction (scanning direction) which is orthogonal to a conveyance direction (sub-scanning direction) of the recording medium, such as a sheet of paper. Among inkjet recording systems, a bubble jet recording system is a system which discharges ink from a discharge port by the pressure of a bubble generated by heating the ink rapidly to turn it into a gas by an electrothermal transducer (hereinafter, sometimes referred to as a "heater").

FIGS. 14A and 14B illustrate a prior art recording head 11 of a bubble jet recording system. FIG. 14A is a plan view of the main parts of the recording head 11, and FIG. 14B is a cross-sectional view taken along the line 14B-14B of 14A.

In FIGS. 14A and 14B, a substrate 1, heaters 2, an orifice plate 4, and discharge ports 5 are provided. Further, ink flow paths 10 are formed between the substrate 1 and the orifice plate 4, and a partition wall 9 is provided between the plurality of ink flow paths 10. In addition, an ink supply port 8 is formed on the substrate 1. The heaters 2 are provided on the substrate 1 so as to face the discharge ports 5. A protective film is formed on the surface of the heaters 2. Ink is supplied from a common fluid chamber (not-illustrated) in communication with the ink flow paths 10 to the respective discharge ports 5 via the ink flow paths 10. When a drive pulse is applied to the heaters 2 provided at a position that faces the respective discharge ports 5, the ink is rapidly heated, and thereby ink is discharged from the discharge ports 5.

However, even when a similar drive pulse is applied to the heaters 2, the ink discharge amount differs depending on the temperature of the ink near the heaters 2. Further, if drive pulses are continuously applied to the heaters 2, heat accumulates in the recording head 11. Thus, if ink is continuously discharged from the recording head 11, this causes an increase in the ink temperature near the heaters 2, and thereby the ink discharge amount increases.

FIGS. 15A to 15C are prior art diagrams illustrating the relationship between the recording head temperature and the ink discharge amount. Here, since measuring the ink temperature near the heaters 2 is practically difficult, generally the temperature is measured by providing a thermistor in the recording head, which acts as a substitute measuring for the ink temperature near the heaters 2. FIGS. 15B and 15C respectively illustrate the relationship between the recording head temperature Th and the recording position, and between the ink discharge amount Vd and the recording position when the recording head 11 is scanned from a recording position A to a recording position B while the ink is continuously discharged from the recording head 11 as illustrated in FIG. 15A. As illustrated in FIGS. 15B and 15C, the recording head temperature Th increases as the scanning proceeds from the recording position A to the recording position B, and with the increase of this recording head temperature Th, the ink discharge amount Vd also increases. Therefore, as illustrated in FIG. 15A, the recorded image has recording density increasing from recording position A towards recording position B, so that density unevenness occurs along the scanning direction.

Accordingly, in the recording method discussed in Japanese Patent Application Laid-Open No. 8-156258, valid data from among the recording data is counted for each scan, and when this count value exceeds a reference value, the subsequent recording data in that scan is thinned, or the pulse width of the pulse signals driving the recording head 11 is reduced. According to this recording method, the effects of an increase in the ink discharge amount caused by the increase in the recording head temperature, namely the density unevenness in the scanning direction, can be reduced.

However, in the recording method discussed in Japanese Patent Application Laid-Open No. 8-156258, in some cases, regions where the recording density suddenly changes exist, which causes image quality to deteriorate.

This phenomenon will now be described referring to FIG. 16. FIG. 16 is a prior art diagram illustrating a region where the recording density suddenly changes, which is formed on a recording medium 21 when an image is recorded by the recording method discussed in Japanese Patent Application Laid-Open No. 8-156258. In FIG. 16, an image is recorded by scanning the recording head 11 in a scanning direction indicated by arrow A while ink is discharged from the recording head 11, and by conveying the recording medium 21 in a sub-scanning direction indicated by arrow B between scans. That is, among the regions to be recorded in the recording medium, an image is recorded on a recording region 22 of the recording medium 21 by successively recording the image on scanning regions (bands) 23, over each of which the recording head 11 performs one scan. Here, the recording head 11 records on the recording medium 21 by discharging ink only when scanning in the same direction as the arrow A.

In the recording method discussed in Japanese Patent Application Laid-Open No. 8-156258, recording is performed by counting valid data from among the recording data for each scan, and when the count value exceeds a reference value, thinning the subsequent recording data in that scan, or reducing the pulse width of the pulse signals, which drives the recording head 11. Cases, when the count value exceeds the reference value and thinning the recording data is performed, will be described below.

At a position of a boundary line 24 illustrated in an N-th region to be recorded by an N-th scan of the recording head 11 (N-th scanning region), the count value of valid data at this position reaches the reference value. This boundary line 24 is an imaginary line illustrating that the recording data was thinned from this position.

In the region 25A, which is located in the left side of the boundary line 24, since the temperature of the recording head has increased caused by the scanning of the recording head 11, the ink discharge amount in this region is increased. Therefore, in the region 25A, the image is recorded with a higher recording density.

However, the change in recording density caused by the increase in the ink discharge amount in the region 25B, which is located on the right side of the boundary line 24, can be suppressed by thinning the recording data. By thinning the recording data in the midst of scanning in this way, density unevenness in the scanning direction can be mitigated even if the ink discharge amount increases due to an increase in the recording head temperature.

However, if the recording data is thinned from a certain position such as the boundary line 24, the recording density temporarily decreases across the boundary line 24. As a result, a substantial difference in recording density occurs between the position immediately after the start of thinning of the recording data in the right side of the boundary line 24 and the left side of the boundary line 24 where the recording data is not thinned. That is, the vicinity of the boundary line 24 becomes a region where recording density suddenly changes. This is visually perceived as density unevenness, thus causing deterioration in image quality.

Further, it is assumed that also in the next scanning region of the N-th scanning region (N+1-th scanning region), the count value of the valid data reaches the reference value at the similar position in the scanning direction as the N-th scanning region. In such a case, because regions where the recording density suddenly changes are continuous in the sub-scanning direction, this is more easily perceived as density unevenness, which causes a further deterioration in image quality. Thus, if regions where the recording density suddenly changes are continuous in the sub-scanning direction, that will deteriorate the quality of the image to be recorded on the recording medium to a large extent.

SUMMARY OF THE INVENTION

An object of the present invention is directed to a recording apparatus that can suppress deterioration in image quality caused by the formation of a region where the recording density suddenly changes when recording while thinning recording data.

According to an aspect of the present invention, a recording apparatus for recording an image on a recording medium by scanning the recording medium with a recording head for discharging ink includes a thinning unit configured to thin data for discharging ink by the recording head on a plurality of areas formed by dividing scanning regions including at least a first scanning region and a second scanning region to be recorded each by one scan of the recording head in the scan direction, and a recording head drive unit configured to discharge ink by driving the recording head based on data which has been thinned by the thinning unit, wherein a boundary between the areas in the first scanning region is located in a different position from that of a boundary between areas in the second scanning region, which is adjacent to the first scanning region, in the scan direction.

According to an exemplary embodiment, to reduce the effects of an increase in the ink discharge amount caused by an increase in the recording head temperature, deterioration in image quality caused by the formation of a region where the recording density suddenly changes when recording while thinning recording data can be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 10A to 10D are diagrams illustrating sequential multiscan (SMS) thinning processing.

FIG. 12 is a diagram schematically illustrating multivalued input data.

DETAILED DESCRIPTION OF THE EMBODIMENTS

Various exemplary embodiments, features, and aspects of the invention will be described in detail below with reference to the drawings.

Figure 4:
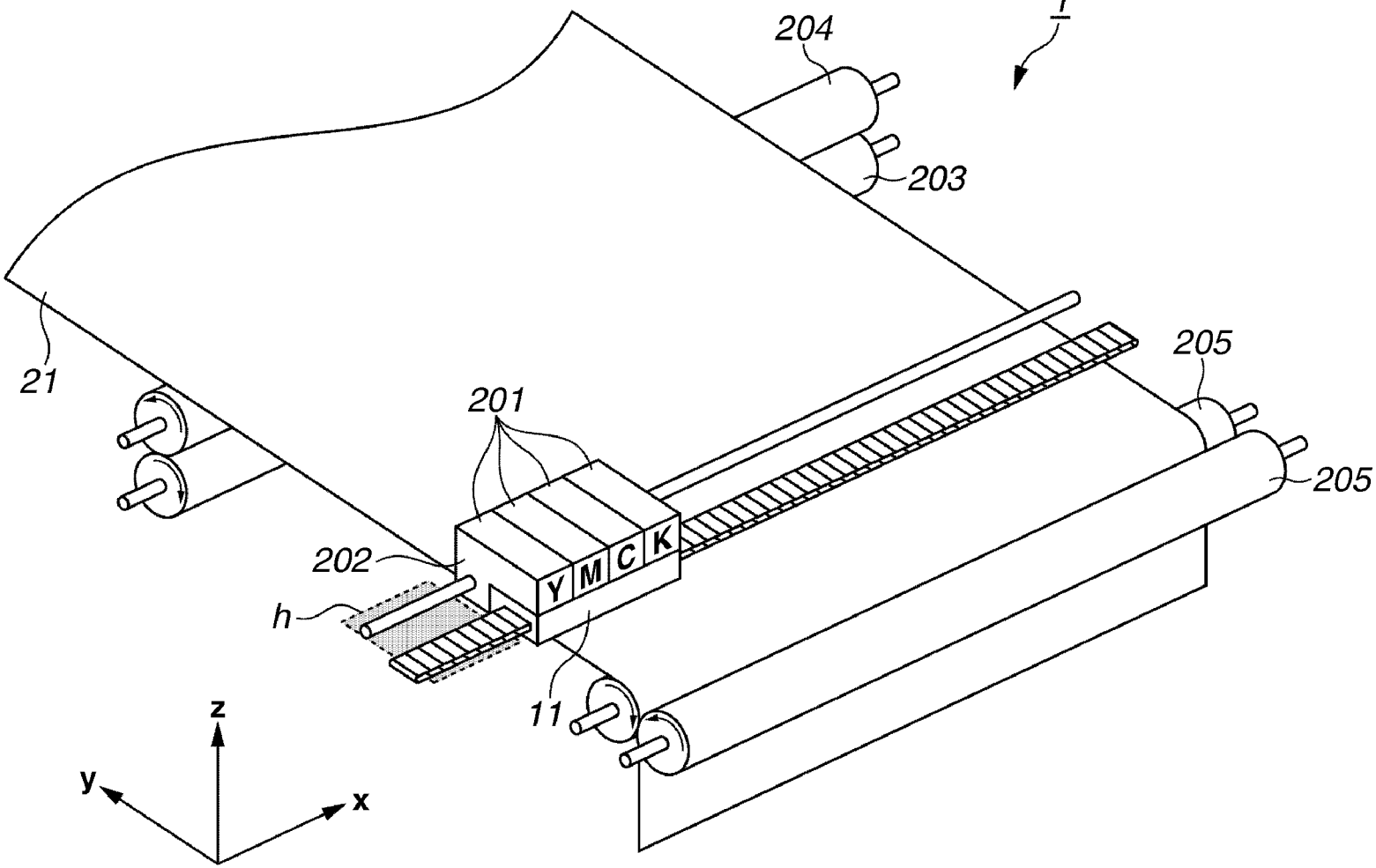
FIG. 4 is an external perspective view of an inkjet recording apparatus according to the exemplary embodiments of the present invention.

FIG. 4 is an external perspective view of an inkjet recording apparatus 1 according to an exemplary embodiment of the present invention.

An inkjet cartridge 201 includes an ink tank which stores four color inks, respectively black, cyan, magenta, and yellow, and a recording head 11 which corresponds to the respective inks.

A conveyance roller 203 rotates in the direction indicated by an arrow while sandwiching a recording medium 21 with an auxiliary roller 204 to intermittently convey the recording medium 21 in the y direction (sub-scanning direction) Further, a pair of paper supply rollers 205 supplies the recording medium 21. Similarly to the conveyance roller 203 and the auxiliary roller 204, the pair of paper supply rollers 205 rotates while sandwiching the recording medium 21 therebetween. The rotation speed is slower than that of the conveyance roller 203, which allows tension to be generated on the recording medium 21, thus enabling conveyance without any distortion.

Next, the configuration of a recording head drive unit, which discharges inks by driving a recording head will be described. A carriage 202 reciprocally moves (reciprocally scans) in a scanning direction (the x direction in FIG. 4) that intersects (is orthogonal to) the above-mentioned y direction, while supporting the four inkjet cartridges 201. When recording is not performed by the recording head 11, or when recovery processing of the recording head 11 is performed, this carriage 202 waits at a home position h illustrated by the dashed line.

The carriage 202, which is at the home position h before recording starts, scans in the x direction once a recording start instruction is issued. At that time, ink is discharged from the 256 discharge ports of the recording head 11 to record an image to be recorded on the recording medium 21 at a 256/1200 inch width (each of the discharge ports is arrayed at an interval of 1/1200 of an inch). Once recording is finished as far as the edge of the recording medium 21, the carriage 202 returns to its original home position h, and again performs scanning for recording the image in the x direction. After the recording by this initial scan is finished, and before the recording by the second scan is started, the recording medium 21 is conveyed 256/1200 of an inch in the y direction by rotating the conveyance roller 203 in the direction indicated by the arrow.

Thus, for example, one page worth of recording can be completed by repeatedly recording 256/1200 of an inch by the recording head 11 and conveying the recording medium 21 for each scan of the carriage 202. This recording mode is referred to as a "one pass recording mode".

Another example of a recording mode to be usable in the inkjet recording apparatus 1 is a "multipass recording mode". It is generally known that in a multipass recording mode, an image, in a region, is recorded by performing a plurality of times divided recording to complete the recording, and that as the number of passes increases, the image quality becomes better.

Further, the inkjet recording apparatus 1 can complete recording by using a bidirectional recording mode in which the first scan and the second scan are performed respectively in opposite directions to each other along x direction.

Figure 14A:
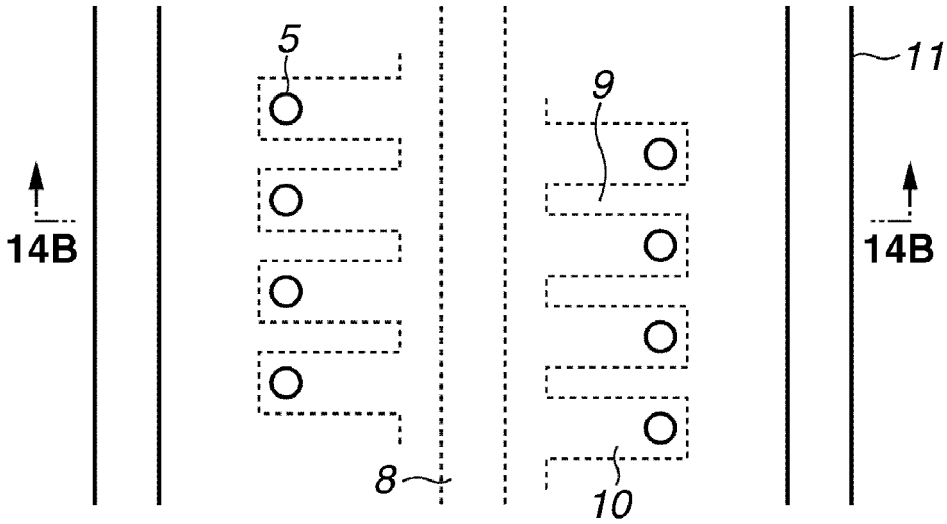
FIGS. 14A and 14B are prior art explanatory diagrams of a bubble jet recording system recording head.
Figure 14B:
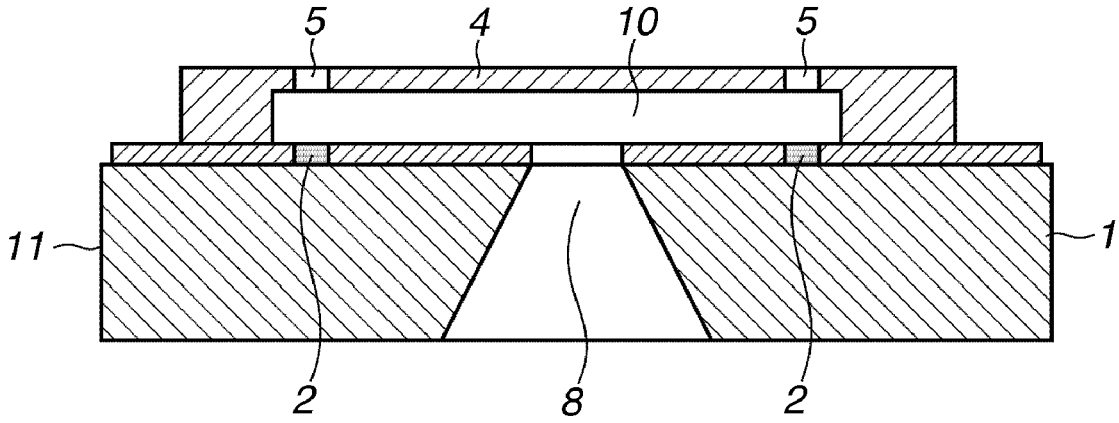
Figure 15A:
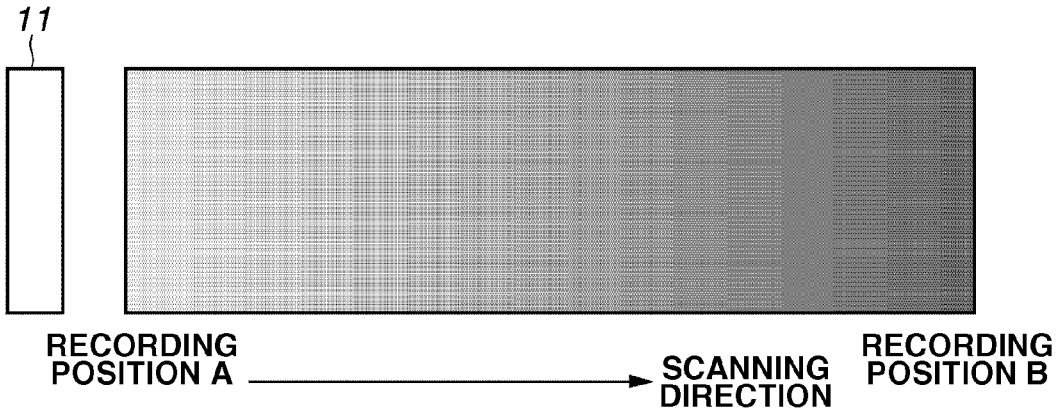
FIGS. 15A to 15C are prior art diagrams illustrating the relationship between recording head temperature and ink discharge amount.
Figure 15B:
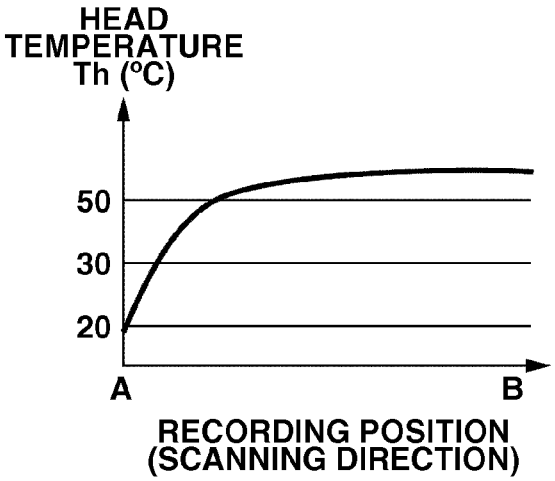
Figure 15C:
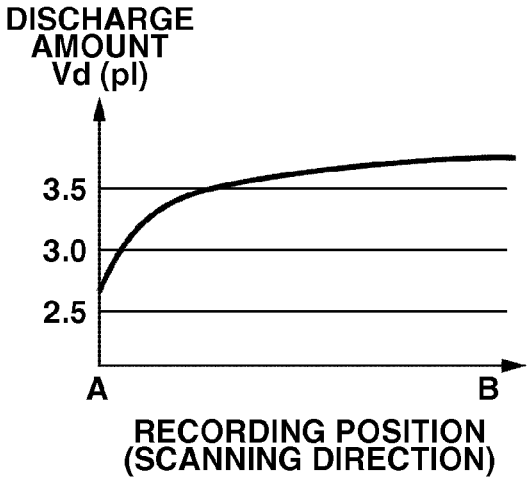
Figure 16:
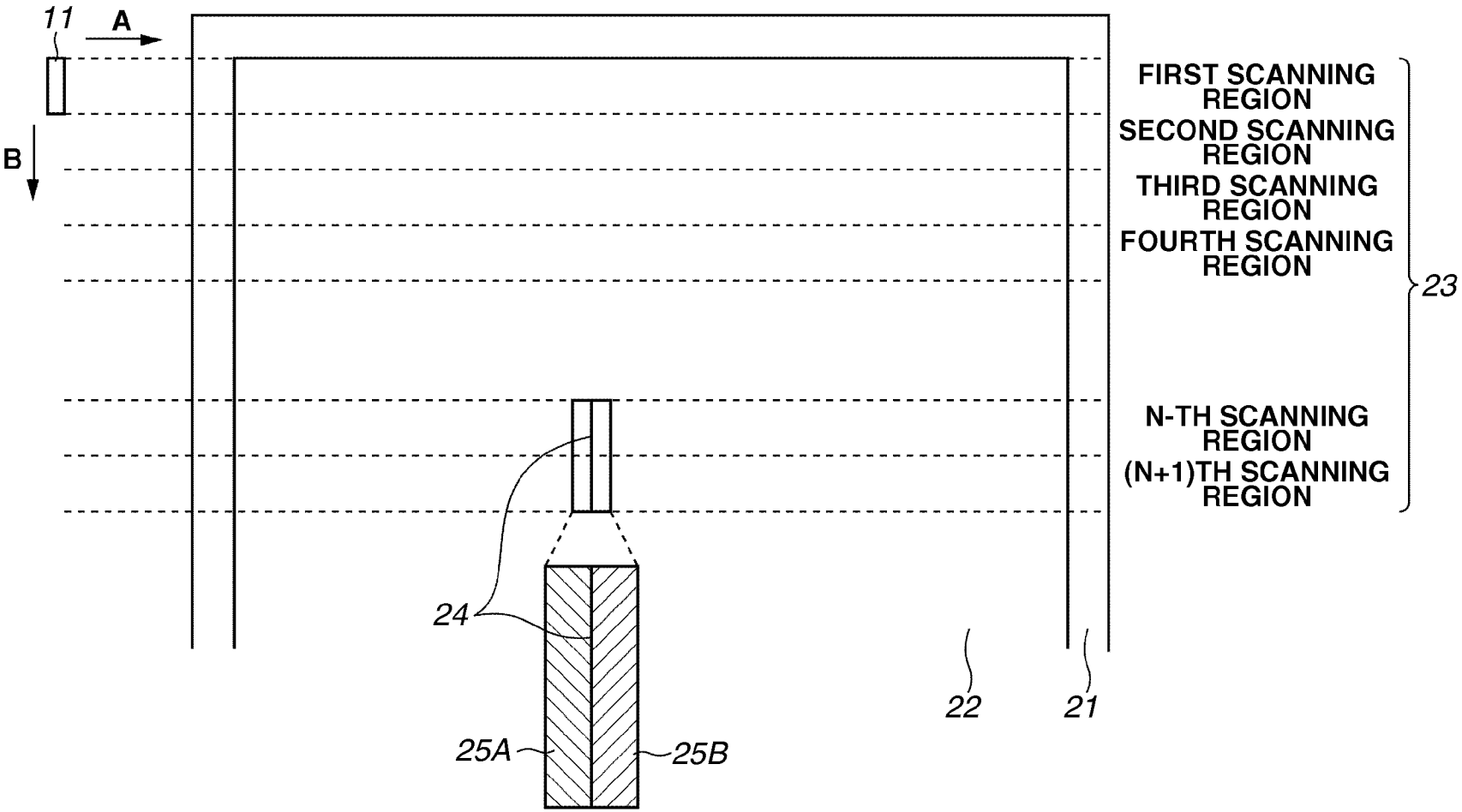
FIG. 16 is a prior art diagram illustrating a conventional recording method.

The configuration of the recording head 11 and the array of the discharge ports 5 in the present exemplary embodiment is similar to that in the recording head 11 illustrated in FIGS. 14A and 14B, and the respective discharge ports 5 are arrayed at intervals of 1/1200 of an inch.

Figure 5:
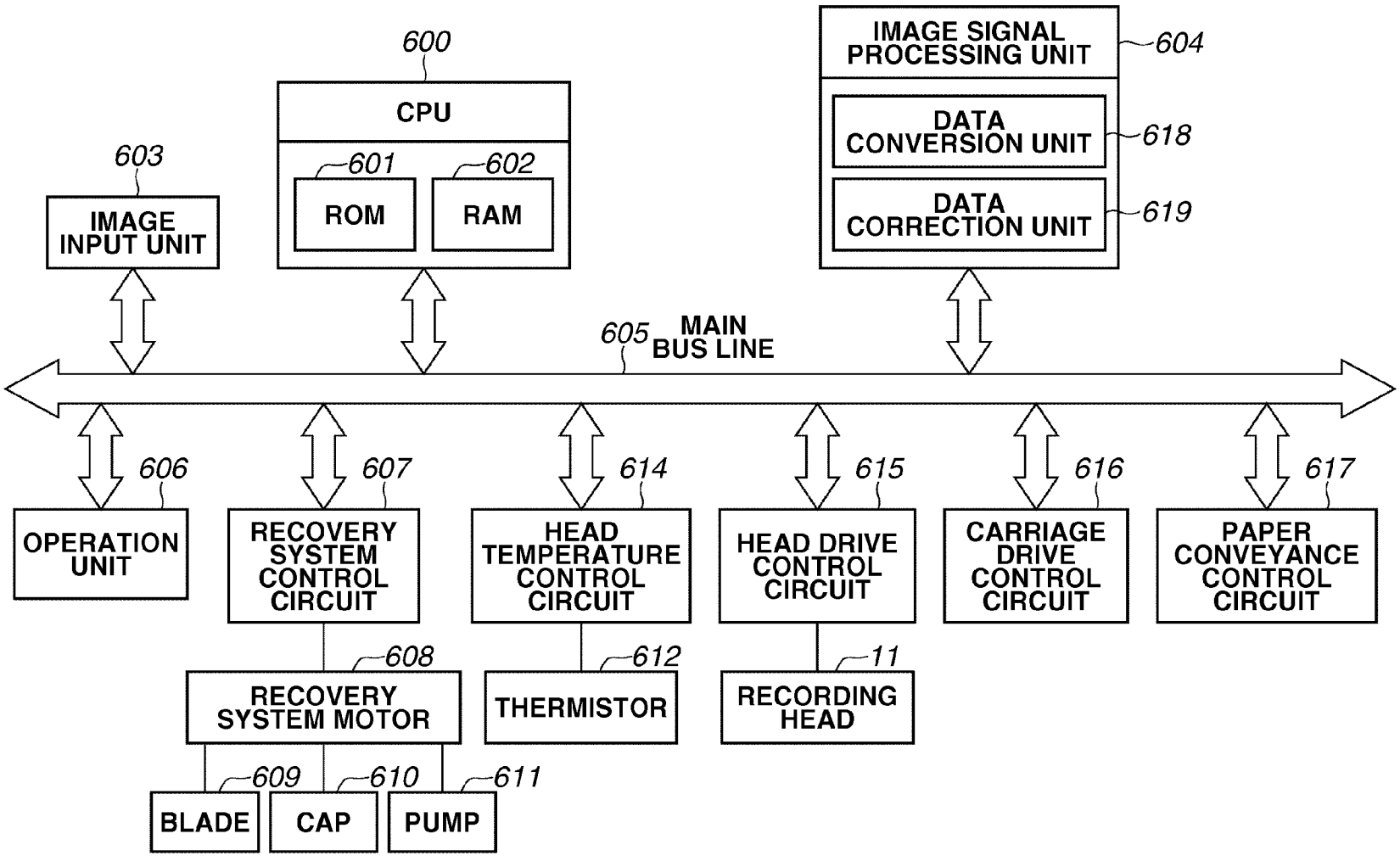
FIG. 5 is a block diagram illustrating a control configuration in the inkjet recording apparatus according to the exemplary embodiments of the present invention.

FIG. 5 is a block diagram illustrating a control configuration in the inkjet recording apparatus 1 according to the present exemplary embodiment.

A central processing unit (CPU) 600 controls units of the inkjet recording apparatus 1 via a main bus line 605 and performs data processing. Namely, the CPU 600 controls respective units described below such as a head temperature control circuit 614, a head drive control circuit 615 and a carriage drive control circuit 616, and performs data processing, based on programs stored in a read only memory (ROM) 601. A random access memory (RAM) 602 is used as a work area for data processing and the like by the CPU 600.

Examples of other storage apparatuses include a hard disk (not-illustrated ). An image input unit 603 has an interface with a host apparatus, and temporarily holds an image, which is input from the host apparatus. An image signal processing unit 604 includes a data conversion unit 618, which performs color conversion, binarization, mask processing and the like, and a data correction unit 619, which executes a recording data correction processing described below. An operation unit 606 includes keys or the like, which enable control input by an operator.

A recovery system control circuit 607 controls recovery operations, such as preliminary discharge, based on a recovery processing program stored in the RAM 602. A recovery system motor 608 drives, for example, a cleaning blade 609, which is arranged facing and slightly apart from the recording head 11, a cap 610, and a suction pump 611.

Further, the head drive control circuit 615 controls the driving of a heater provided in the recording head 11, and causes the recording head 11 to discharge ink for recording based on recording data on which correction processing has been executed by the data correction unit 619. Further, based on a recovery processing program, ink is also discharged for preliminary recording. In addition, based on programs, the carriage drive control circuit 616 and a paper conveyance control circuit 617 similarly respectively control movement of the carriage and conveyance of the recording medium.

Further, a keep-warm heater is provided on the substrate, on which the heater for discharging ink in the recording head 11 is provided, so that the ink temperature in the recording head can be adjusted to a desired set temperature. A thermistor 612 is similarly provided on the substrate for measuring the substantial temperature of the ink in the recording head 11. Similarly, the thermistor 612 can also be provided outside of the substrate, or can be provided near the periphery of the recording head 11.

Figure 6:
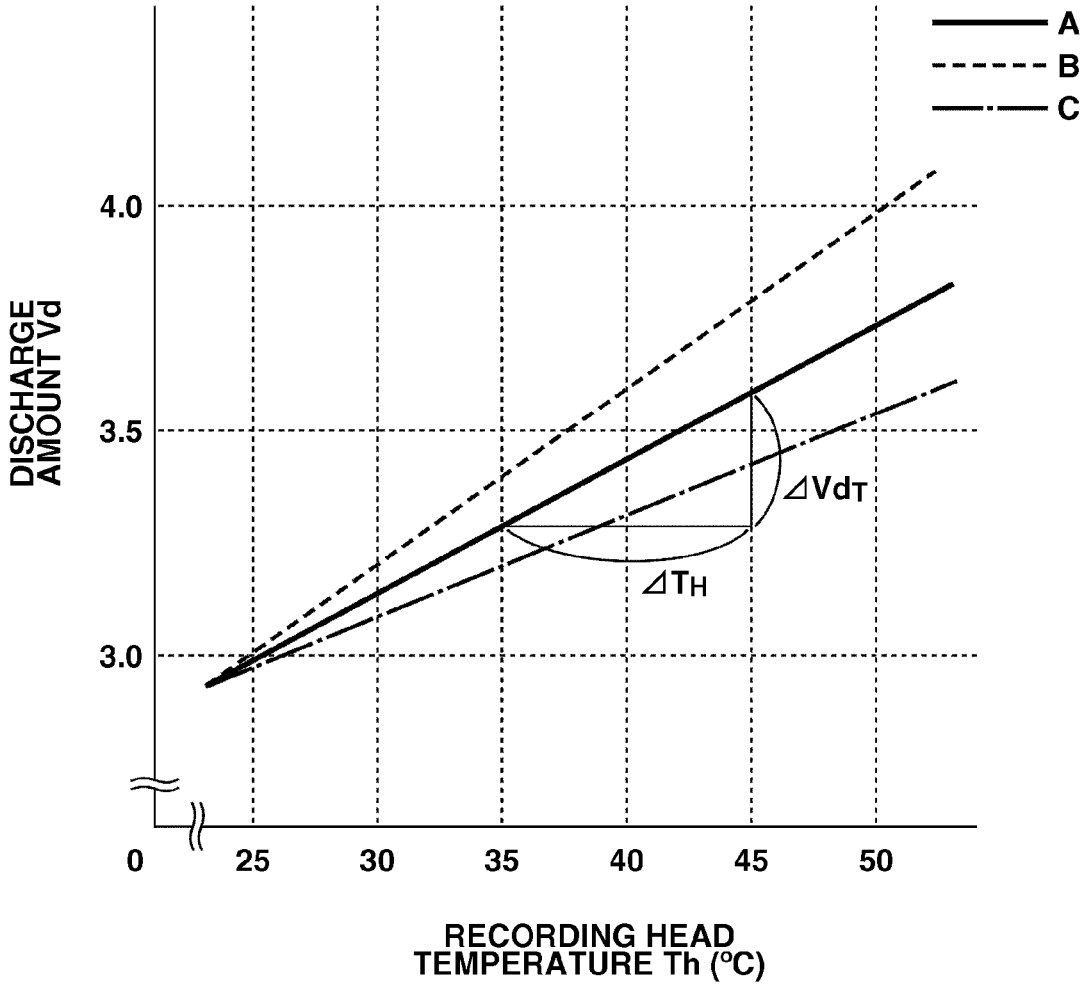
FIG. 6 is a diagram illustrating temperature dependency of an ink discharge amount.

Next, in the present exemplary embodiment, a recording method for suppressing the effects of an increase in the ink discharge amount caused by an increase in the recording head temperature will be described. Factors that determine the ink discharge amount of the recording head include the ink temperature (recording head temperature) of the recording head discharge unit. FIG. 6 is a diagram illustrating the temperature dependency of the ink discharge amount when the drive pulse conditions for driving the recording head are fixed. As illustrated by curve A, the discharge amount Vd increases linearly with respect to the increase in the recording head temperature Th. If this linear slope is defined as the temperature dependency coefficient, the temperature dependency coefficient is expressed as $K_T = \Delta Vd_T / \Delta Th$ (p1/° C.·dot).

This coefficient $K_T$ is determined by the ink properties of the head regardless of the drive pulse conditions. FIG. 6 also similarly illustrates the cases when other recording heads were used as curves B and C. In the present exemplary embodiment, fluctuation of the ink discharge amount due to fluctuation of the recording head temperature is controlled so that the recording density on the recording medium becomes constant by using image correction in which the total dot number of the image data to be recorded is varied. As the correction method of such recording data, a method, which corrects the fluctuation of the ink discharge by thinning binarized data, is employed. The processing is performed by the data correction unit 619 in the image signal processing unit 604 in the apparatus control block illustrated in FIG. 5. The processing performed by this data correction unit 619 will now be described in more detail.

Figure 1:
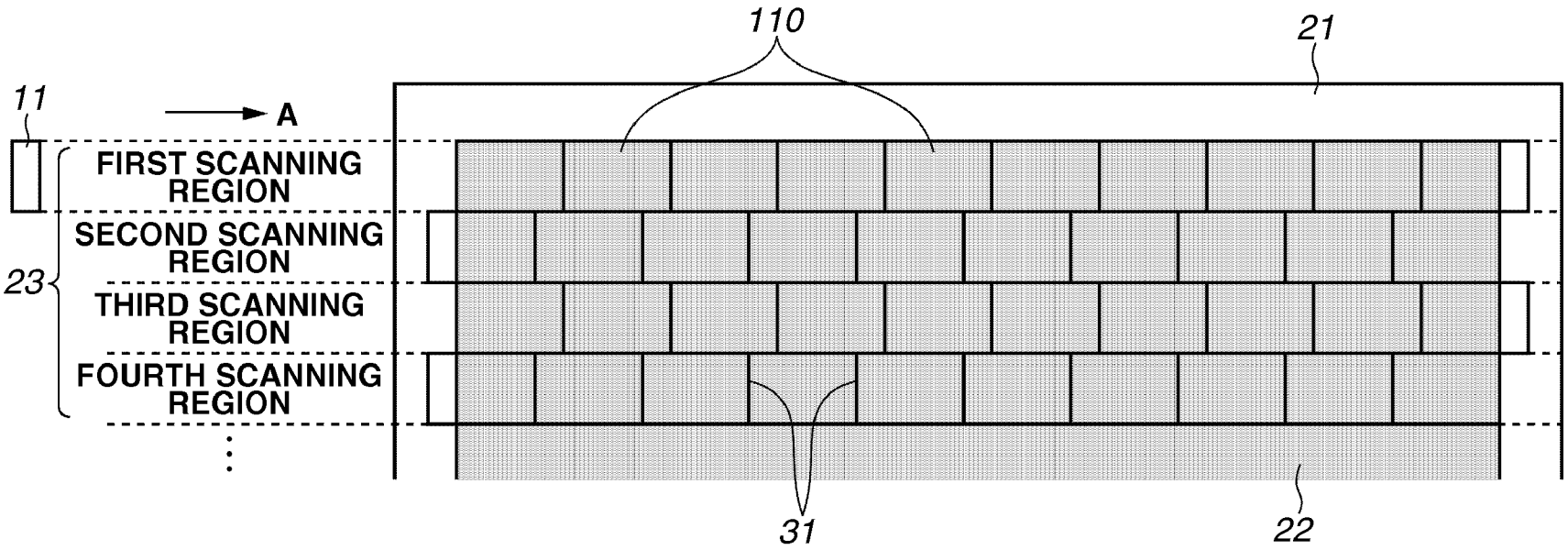
FIG. 1 is a diagram illustrating the setting of areas in a first exemplary embodiment of the present invention.

FIG. 1 is a diagram illustrating the recording method in the present exemplary embodiment, and illustrates a method for setting the areas 110 as described below. An image is recorded in the recording region 22 by recording the image in scanning regions 23 in series, each of which is a region capable of being recorded by one scan of the recording head 11. Here, the image is recorded from a first scanning region to an L-th scanning region in series. The recording is performed by a bidirectional recording mode, in which recording is performed during scanning in both directions of the recording head 11, and by a one pass recording mode. However, in FIG. 1, only the recording regions from the first scanning region to a fourth scanning region are illustrated.

First, the flow of steps of the recording method in the present exemplary embodiment will be described. A plurality of areas 110 are set in odd-numbered scanning regions, in which recording is performed when scanning in the direction indicated by arrow A (forward scanning), and in even-numbered scanning regions, in which recording is performed when scanning in the opposite direction to the direction indicated by arrow A (backward scanning). Then, the number of dots (recording dot number) of ink to be discharged in the areas 110 is counted based on the discharge data (among the recording data, data having a value of "1" indicating that ink should be discharged) of the recording data corresponding to the respective areas 110. Further, the dot count processing described below is executed based on the count result. Using the dot count processing result, correction processing is performed to convert the discharge data into non-discharge data (data having a value of "0" indicating that ink should not be discharged).

Next, the method for setting the areas 110 will be described. The areas 110 are set by dividing an area setting region into N areas in a sub-scanning direction and M areas in a scanning direction. This area setting region is a region that corresponds to each scanning region. In the present exemplary embodiment, this area setting region is a region in which the length of the area setting region in the sub-scanning direction is the same as that of the scanning regions, and the length of the area setting region in the scanning direction is longer than that of the scanning regions. Describing this more specifically using specific numbers, first, the recording width (length in the scanning direction of the scanning regions) is 8 inches in the present exemplary embodiment, the scanning regions have 256 pixels along the sub-scanning direction, and 9600 pixels (=8×1200 dpi) along the recording width direction. Further, the length along the scanning direction in the area setting region is set as 10000 pixels, which is 400 pixels longer than that of the scanning regions, and the thus-defined area setting region is divided by N=1 along the sub-scanning direction and M=10 along the scanning direction. That is, the areas 110 are set as regions each having a size of 256 pixels in the sub-scanning direction and 1000 pixels in the scanning direction. In addition, in this setting, for odd-numbered scanning regions, the left edge is aligned with the left edge of the area setting region, and for even-numbered scanning regions, the right edge is aligned with the right edge of the area setting region. Thus, area setting regions (a first setting region and a second setting region) adjacent in the sub-scanning direction alternately protrude to the right or the left of the scanning regions. That is, in odd-numbered scanning regions, the area setting regions protrude to the right of the scanning regions, and in even-numbered scanning regions, the area setting regions protrude to the left of the scanning regions.

FIG. 1 illustrates the positional relationship between thus-set areas 110 and the scanning region 23. As is also clear from FIG. 1, the areas 110 alternately protrude to the right or the left of the scanning regions respectively in odd-numbered scanning regions and even-numbered scanning regions so that the areas 110 protrude from the recording region near the scanning finish position of the recording head. Since the areas 110 are set in this manner, the boundaries (area boundary lines 31) of the areas 110 adjacent in the scanning direction have a different position in the scanning direction for the odd-numbered scanning regions and the even-numbered scanning regions.

Next, using FIGS. 1 and 2, the dot count processing of the present exemplary embodiment and the correction processing of the recording data based on the dot count result will be described. First, using FIG. 1, the three pieces of count data used for the dot count processing will be described.

There are three pieces of count data, which are used in the dot count processing of the present exemplary embodiment, including a dot count value E, an integrated dot count value Sm, and a total dot count value Sa. The number of dots of ink to be recorded by an 1-th scan and discharged in an area (m, n), which is an m-th area from the left edge of a recording region and an n-th area from the top edge of the recording region, is defined as the dot count value E (m, n). In the present exemplary embodiment, since the length in the sub-scanning direction of the areas 110 is set to be the same as the length in the scanning region 23, 1=n. Further, the integrated recording dot number in the 1-th scan to be recorded by the area (m, n) is defined as the integrated dot count value Sm(m, n), and the total of the recording dot number from the first scan to the immediately-prior scan (i.e., 1 minus the first scan) is defined as the total dot count value Sa (1−1). Further, to perform the correction processing on the recording data of area (m, n), the correction amount calculated by area (m, n) is defined as H(m, n).

For example, the value represented by Sm(5, 1) represents a value in which the values from the dot count values E(1, 1) to E (5, 1) are added. Further, Sa (3) represents a value in which the integrated dot count values in the respective scans from the first scan after the start of recording to the third scan are added. In addition, H (1, 1) represents the correction amount in the area (1, 1) of the first area in the scanning direction from the left edge of the recording region and the first area in the sub-scanning direction from the top edge of the recording region.

Figure 2:
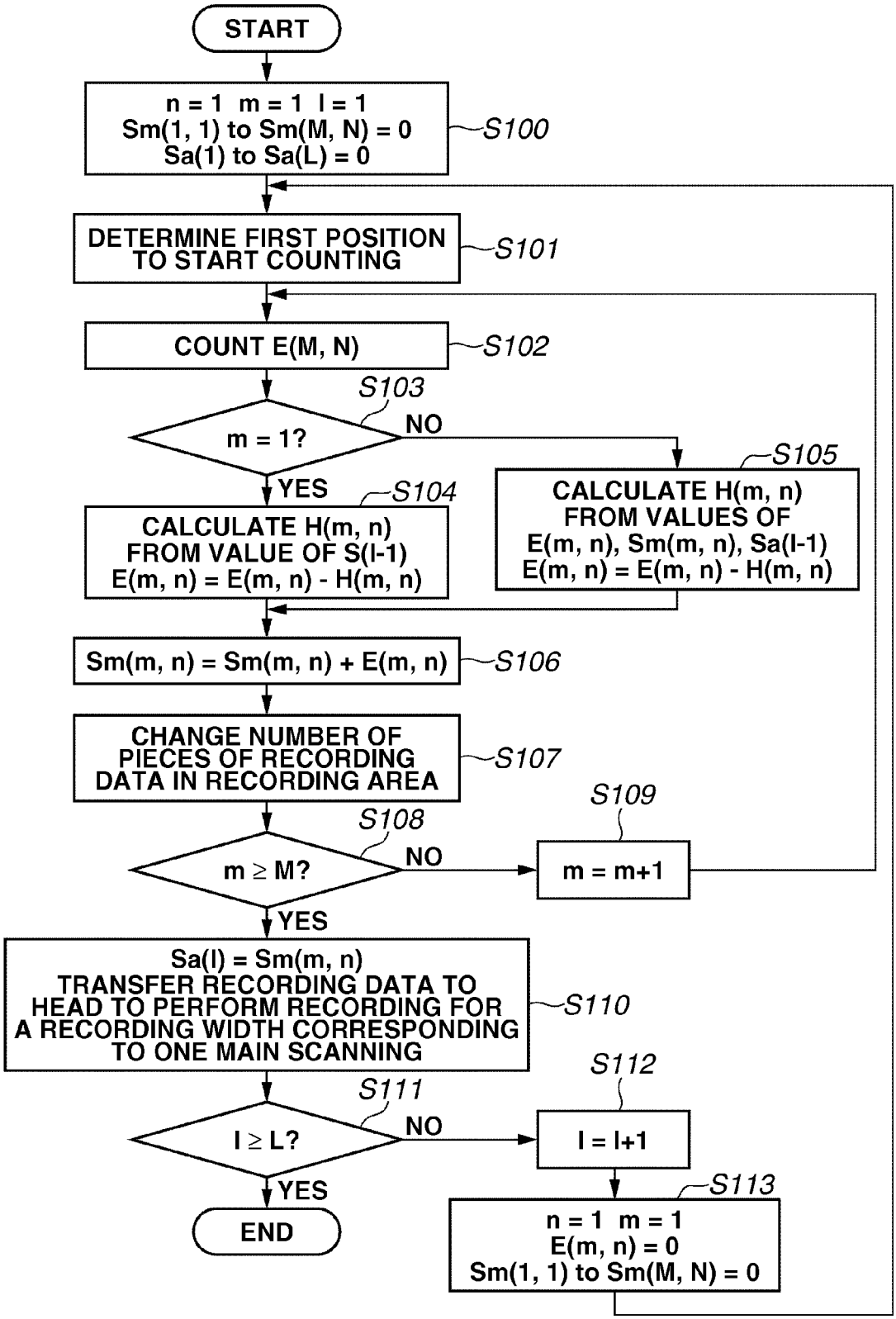
FIG. 2 is a flowchart of dot count processing and correction processing in the first exemplary embodiment.

FIG. 2 is a flowchart illustrating dot count processing and recording data correction processing.

This dot count processing is started up for each scan. First, in step S100, the CPU 600 determines the area (m, n), which will be the target of the dot count and the correction processing, to be m=1, and n=1. Further, the memory region in the register etc., storing the values for Sm (1, 1) to Sm (M, N), and Sa (0) to Sa (L), is initialized.

In step S101, the CPU 600 matches the first position to start counting of the area (1, 1), which is the target area of the dot count, to the first position of the data of the recording data.

In step S102, the CPU 600 counts the discharge data in area (1,1) of the first area in the scanning direction and the first area in the sub-scanning direction, and temporarily stores the value in the memory region as dot count value E(1, 1).

In step S103, the CPU 600 determines whether the area, in which dot counting was performed in step S102, is the first area in the scanning direction, that is, whether the area is the first position in the scanning direction. If that area is the first area in the scanning direction (YES in step S103), the processing proceeds to step S104, while if that area is not the first area (NO in step S103), the processing proceeds to step S105.

In step S104, the CPU 600 calculates the correction amount H (1, 1) based on the total dot count value Sa (0) (since at this stage the first scan is being performed, there is no number of ink dots up until right before). Then, the CPU 600 sets the value obtained by subtracting the correction amount H (1, 1) from the dot count value E (1, 1) of this area to a new dot count value E (1, 1).

In step S106, the CPU 600 adds E (1, 1) to the value of the integrated dot count value Sm (m, n), and stores this as a new integrated dot count value Sm (1, 1) in the corresponding memory region.

In step S107, the CPU 600 performs the correction processing corresponding to the correction amount H (1, 1) on the recording data corresponding to area (1, 1). The correction processing of the recording data for area (1, 1) is performed by changing the discharge data portion of the recording data to non-discharge data by just the number corresponding to the correction amount. The details of this processing will be described below.

Further, in step S108, the CPU 600 determines whether m≧M. If m is not greater than or not equal to M (NO in step S108), then in step S109, the CPU 600 increments the value of m by one, and shifts the target area of the dot count processing and the recording data correction processing by one in the scanning direction.

Namely, the CPU 600 repeats the processing of from step S102 to step S109 with m=2, so that the dot count and recording data correction processing are performed on the area (2, 1).

First, in step S102, the CPU 600 counts the discharge data of area (2, 1) of the targeted second area in the scanning direction, and temporarily stores the dot count value E (2, 1) of this area in the memory region.

In step S103, the CPU 600 determines whether the area that underwent dot counting in step S102 is the first area in the scanning direction. Since the target area (2, 1) is the second area in the scanning direction, namely, the target area is not the first area in the scanning direction, the processing proceeds to step S105.

In step S105, the CPU 600 calculates the correction amount H (2, 1) for the area (2, 1) so as to suppress an increase in the expected recording density, based on three pieces of count data, the dot count value E (1, 1), the integrated dot count value Sm (1, 1), and the total dot count value Sa (0). Then, by subtracting the correction amount H (2, 1) from the dot count value E (2, 1), the CPU 600 determines a new dot count value E (2, 1).

In step S106, the CPU 600 adds E (2, 1) determined in step S105 to the integrated dot count value Sm (1, 1), and stores this as a new integrated dot count value Sm (2, 1) in the corresponding memory region.

In step S107, the CPU 600 performs the correction processing corresponding to the correction amount H (2, 1) on the recording data of the target area (2, 1).

Further, in step S108, the CPU 600 determines whether m≧M. If m is not greater than or not equal to M (NO in step S108), in step S109, the CPU 600 increments the value of m by one, and shifts the target area of the dot count processing and the recording data correction processing by one in the scanning direction.

Subsequently, the CPU 600 similarly repeats the processing of from step S102 to step S109 until m≧M is satisfied (YES in step S108), namely, for all of m (1 to M), to perform the dot count processing and the recording data correction processing of each area.

Next, in step S110, the CPU 600 stores the value of the integrated dot count value Sm (m, n) (at this stage, Sm (10, 1)) in the corresponding memory region as a new total dot count value Sa (1). Further, the CPU 600 transfers the recording data that has undergone correction processing for this scanning to the recording head 11 to perform recording. Then, the CPU 600 starts the dot count processing and the recording data correction processing for the next scan.

In step S111, the CPU 600 determine whether 1≧L. If 1 is not greater than or not equal to L (NO in step S111), in step S112, the CPU 600 increments the value of 1 by one, and shifts the target area of the dot count processing and the recording data correction processing by one in the sub-scanning direction.

In step S113, the CPU 600 initializes to zero the memory in which the dot count value E (m, n) and the integrated dot count value Sm (m, n), among the three pieces of count data of up until the scan right before, are temporarily stored.

Subsequently, the CPU 600 performs, while successively performing the dot count processing and the recording data correction processing for each of the areas 110 by repeating the processing of from step S101 to step S113, recording based on the corrected recording data, and completes the recording of the image.

It is noted that the CPU 600 calculates the correction amount H (m, n) based on three pieces of count data, the dot count value E (m, n), the integrated dot count value Sm (m, n), and the total dot count value Sa (m, n). Specifically, as illustrated in the following mathematical expression (1), the CPU 600 can perform the calculation by multiplying the three pieces of count data by the respective coefficients X, Y, and Z. The optimum value for each of these coefficients can be selected in consideration of the properties etc., of the inkjet recording apparatus 1.

$$H(m, n)=X\times E(m, n)\times Y\times Sm(m, n)+Z\times Sa(n)\ (X, Y, \text{and } Z \text{ are real numbers}) \quad (1)$$

Next, the correction processing for the recording data in the present exemplary embodiment will be described. In the present exemplary embodiment, the correction processing is performed on the recording data by using a mask pattern, which is a commonly used correction unit.

Figure 3:
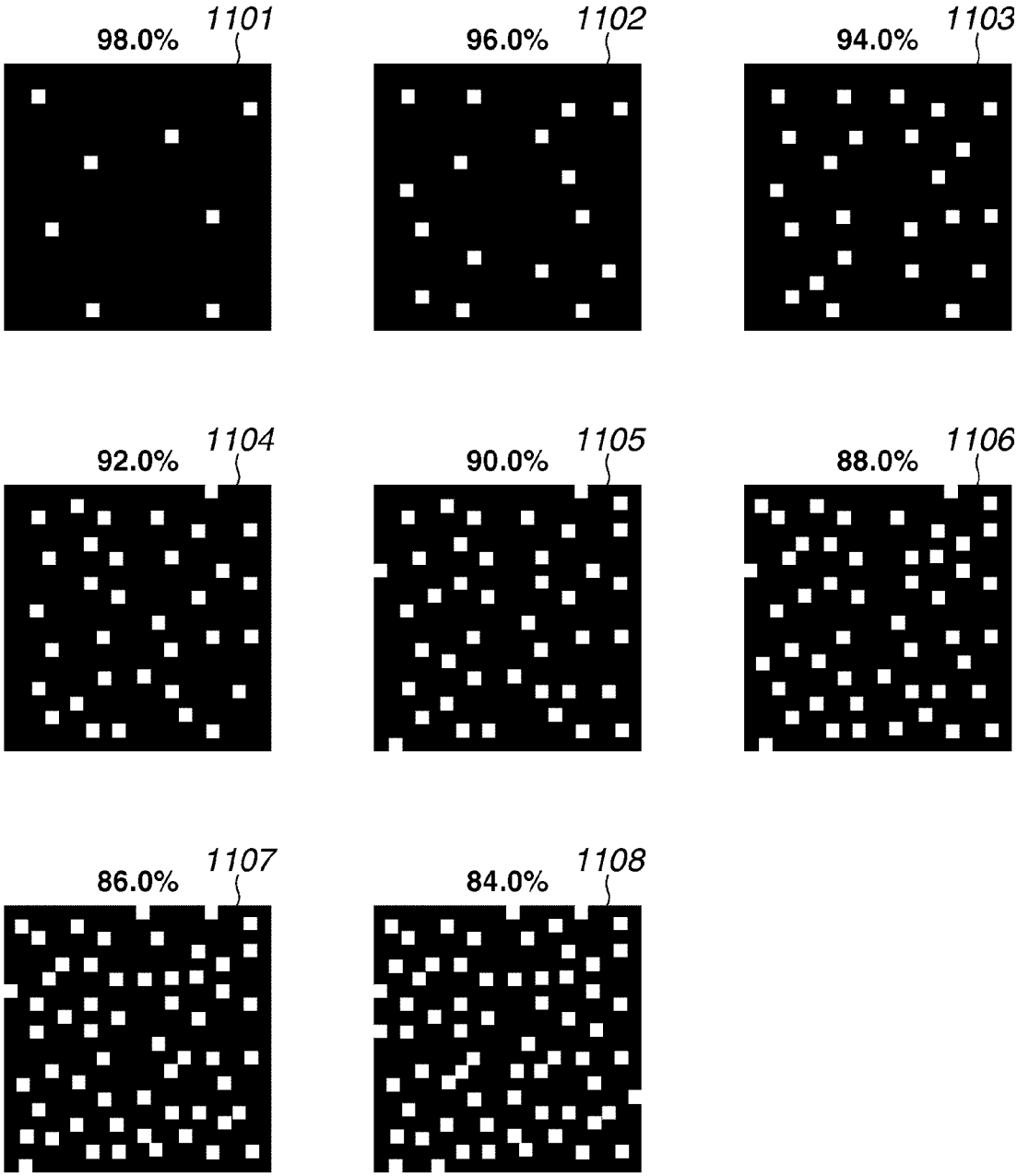
FIG. 3 is a diagram illustrating various kinds of mask patterns used in the correction processing.

FIG. 3 is a diagram illustrating various kinds of mask patterns used for reducing the recording dot number in the areas 110 to a desired recording dot number. Specifically, FIG. 3 illustrates mask patterns 1101, 1102, 1103, 1104, 1105, 1106, 1107, and 1108 for thinning recording data respectively to 98.0%, 96.0%, 94.0%, 92.0%, 90.0%, 88.0%, 86.0%, and 84.0%.

First, when calculating the correction amount H (m, n) in step S104 or step S105, the CPU 600 calculates the ratio of the number of dots to be reduced to the total dot number of the target area (correction ratio) based on the correction amount H (m, n) for the target area. Then, in step S107, the CPU 600 selects a mask pattern having the closest correction ratio from among the above mask patterns based on the calculated correction ratio. The CPU 600 then performs thinning processing on the recording data of the target area by masking the recording data of the target area using the selected mask pattern.

For example, for an area having a total dot number of 100000, if it is calculated that the number of dots to be reduced, based on the correction amount, is 7000 dots, the correction ratio is 93.0% (=(100000−7000)/100000×100). Next, the CPU 600 selects a mask pattern having the closest correction ratio (thinning ratio) to this correction ratio from among the prepared mask patterns. In the case of the present exemplary embodiment, the CPU 600 selects the 92.0% mask pattern, so that the recording data correction processing can be performed by performing a logic operation on the recording data.

For areas which include a region other than the recording region 22, like the right edge area in the odd-numbered scanning regions, if a portion without any recording data is taken as the correction processing target, the thinning amount of the recording data for that area may not be a desired ratio. Therefore, for such areas including a region without any recording data, proper thinning correction can be performed by preparing a mask pattern of different size so that only the portion, in which recording data is present, is masked.

In the present exemplary embodiment, as already described referring to FIG. 1, the areas 110 are set so that the areas 110 alternately protrude to the right and the left of the scanning regions respectively in odd-numbered scanning regions and even-numbered scanning regions. As a result of setting the areas 110 in this manner, the area boundary line 31 of areas 110 adjacent in the sub-scanning direction can be set so that the position of the area boundary line 31 in the scanning direction is different from the area boundary line 31 of adjacent scanning regions.

Depending on conditions of the image to be recorded, the correction amount between areas adjacent in the scanning direction can be greatly different. In such cases, a large difference in recording density, between one area (first area) and another area (second area) sandwiching an area boundary line 31, occurs. As a result, the recording density suddenly changes in the area near the area boundary line 31. However, in the present exemplary embodiment, the area boundary line 31 of a scanning region (first region) is located in a different position along the scanning direction from that of the area boundary line 31 of the adjacent scanning region (second region). That is, in a plurality of adjacent scanning regions, even if regions, in which the recording density suddenly changes, are formed, deterioration in image quality can be reduced, because the regions are not continuous in a sub-scanning direction at the similar position in the scanning direction.

Therefore, according to the present exemplary embodiment, density unevenness along the scanning direction caused by an increase in the ink discharge amount can be reduced, and deterioration in image quality caused by the formation of a region, in which recording density suddenly changes, can be reduced.

In the present exemplary embodiment, as the processing for reducing density unevenness in the scanning direction, dot count processing was performed on each of the areas 110, and correction processing was performed by converting discharge data into non-discharge data based on three pieces of count data. However, the method for reducing density unevenness in the scanning direction is not limited to this method. That is, by applying a conventionally known method, the recording dot number of each area can be counted, and once the count value has reached a reference value, the subsequent recording data can be thinned. Alternatively, the pulse width of the pulse signal for driving the recording head 11 can be made smaller.

Further, the recording mode for recording the image is not limited to a bidirectional recording mode in which recording is performed while scanning is performed in both directions. The recording can also be performed using a unidirectional recording mode.

In addition, the recording method of the present exemplary embodiment does not need to make the position of the area boundary line 31 in the scanning direction different for all of the adjacent scanning regions. That is, even if the position of the area boundary line 31 in the scanning direction is made different for only one pair of adjacent scanning regions, deterioration in image quality for that portion can be reduced.

In the first exemplary embodiment, areas 110 all having the same size are alternately protruded to the right and the left in odd-numbered scanning regions and even-numbered scanning regions, and the position in the scanning direction of the area boundary lines 31 are set so as to differ between adjacent scanning regions. Here, other area setting methods, for example, a method, which does not have an area boundary line 31 that is continuous in the sub-scanning direction, will be described. In the following description, components or portions similar to those described in the first exemplary embodiment are denoted by the same reference numerals and not described below.

Figure 7:
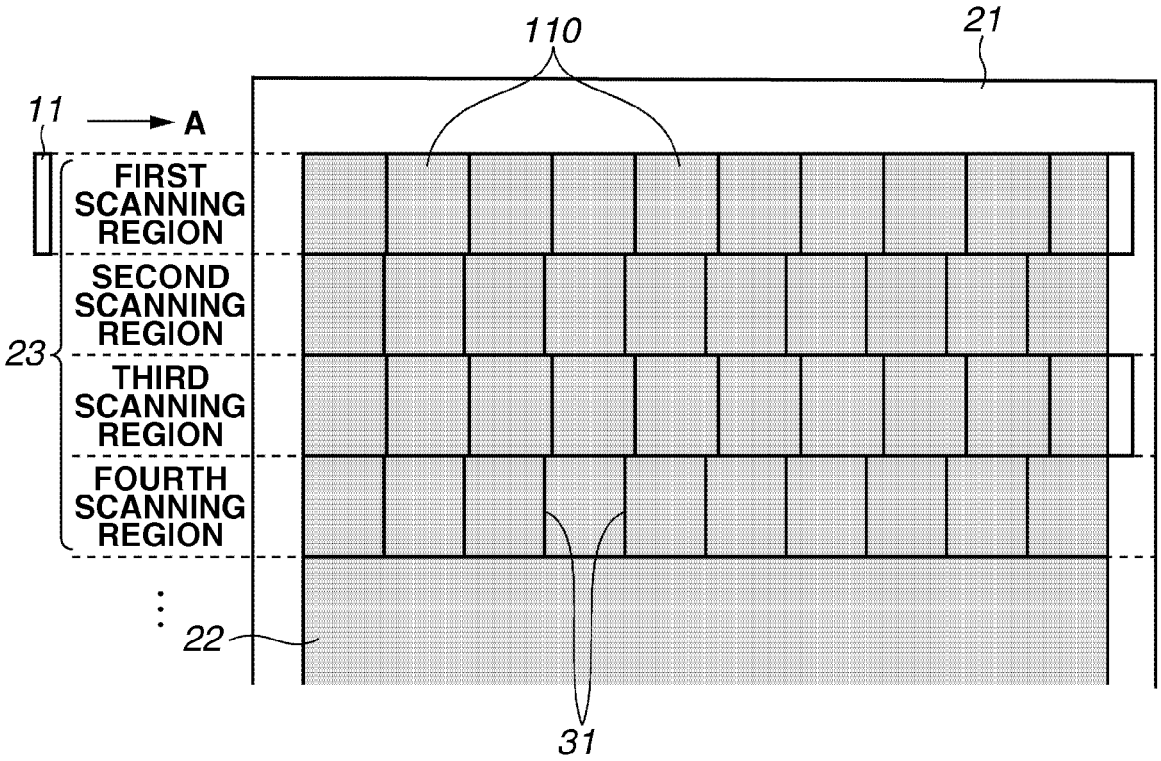
FIG. 7 is a diagram illustrating an example of areas set in a scanning region.

FIG. 7 illustrates an example of another method for setting the areas 110. The areas 110 are set so that their size in the scanning direction differs between the odd-numbered scanning regions and the even-numbered scanning regions.

Specifically, the areas 110 to be set for the odd-numbered scanning regions are set by dividing the area setting region, in which the length in the sub-scanning direction is the same as that of the scanning regions and the length in the scanning direction is longer than the recording width, into N=1 areas in the sub-scanning direction and M=10 areas in the scanning direction. Similarly to the first exemplary embodiment, the length in the scanning direction of the area setting region is 10000 pixels, which is 400 pixels larger than that of the scanning regions. Each area 110 has a size of 256 pixels in the sub-scanning direction and 1000 pixels in the scanning direction.

On the other hand, the areas 110 to be set for the even-numbered scanning regions are set by dividing the area setting region, in which the length in the sub-scanning direction and the length in the scanning direction are the same as those of the scanning regions, into N=1 areas in the sub-scanning direction and M=10 areas in the scanning direction. That is, for the odd-numbered scanning regions, each area 110 is set to have a size of 256 pixels in the sub-scanning direction and 960 pixels in the scanning direction.

Thus, even when areas 110 are set in respectively adjacent scanning regions, the positions in the scanning direction of the area boundary lines 31 are different from the position of the adjacent scanning regions. Therefore, even if a region, in which the recording density suddenly changes, is formed in a plurality of continuous scanning regions, deterioration in image quality caused by the formation of a region, in which the recording density suddenly changes, can be reduced, because that region is not continuous in a sub-scanning direction at the same position in the scanning direction.

Figure 8:
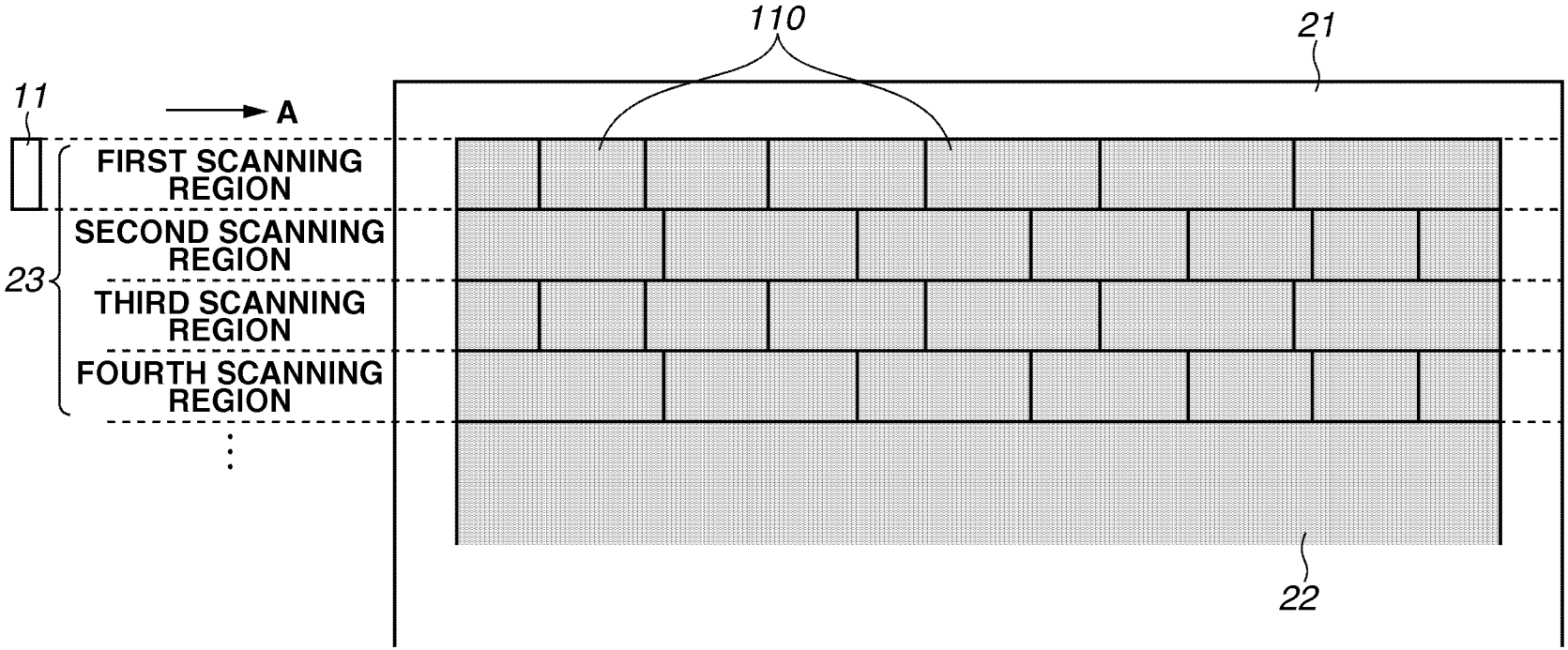
FIG. 8 is a diagram illustrating an example of areas set in a scanning region.

FIG. 8 illustrates an example of yet another method for setting the areas 110. The size in the scanning direction of the areas 110 is set randomly for each scanning region. By setting the areas 110 in this manner, the position in the scanning direction of the area boundary line 31 can be made different from that of the area boundary line 31 of adjacent scanning regions.

Referring to FIG. 8, in odd-numbered scanning regions, the size, in the scanning direction, of the area 110 located in the left side is smaller than or equal to the area 110 located in the right side of the area 110. Further, the size of the area 110 of the left side edge of each scanning region is smaller than the size of the right side edge. Further, in even-numbered scanning regions, the areas 110 are arranged in reverse order in the odd-numbered scanning regions (see FIG. 8). By setting the areas in this manner, and performing recording by a bidirectional recording mode, in which recording is performed in both of the direction of the arrow A and the opposite direction of the arrow A, the size of the areas for any scanning region becomes larger along with the scanning of the recording head.

When recording an image, since the heater rapidly heats up immediately after scanning is started, the discharge amount of the ink tends to be uneven. Accordingly, by setting the areas 110 immediately after scanning is started to be relatively smaller than the areas 110 near the end of scanning, the range of correction processing of the recording data immediately after scanning is started is made smaller, so that the unevenness in the ink discharge amount can be suppressed. To obtain the same effects, it is not necessary to set the area size for all of the areas to increase along with the scanning of the recording head.

Further, it is not necessary to set the value of M for dividing an area setting region to the same value for all of the scanning regions. More specifically, the size in the scanning direction of the areas 110 maybe randomly set for each scanning region by varying the value of the dividing number M for each scanning region, so that the area boundary lines 31 are not continuous in the sub-scanning direction.

Figure 9:
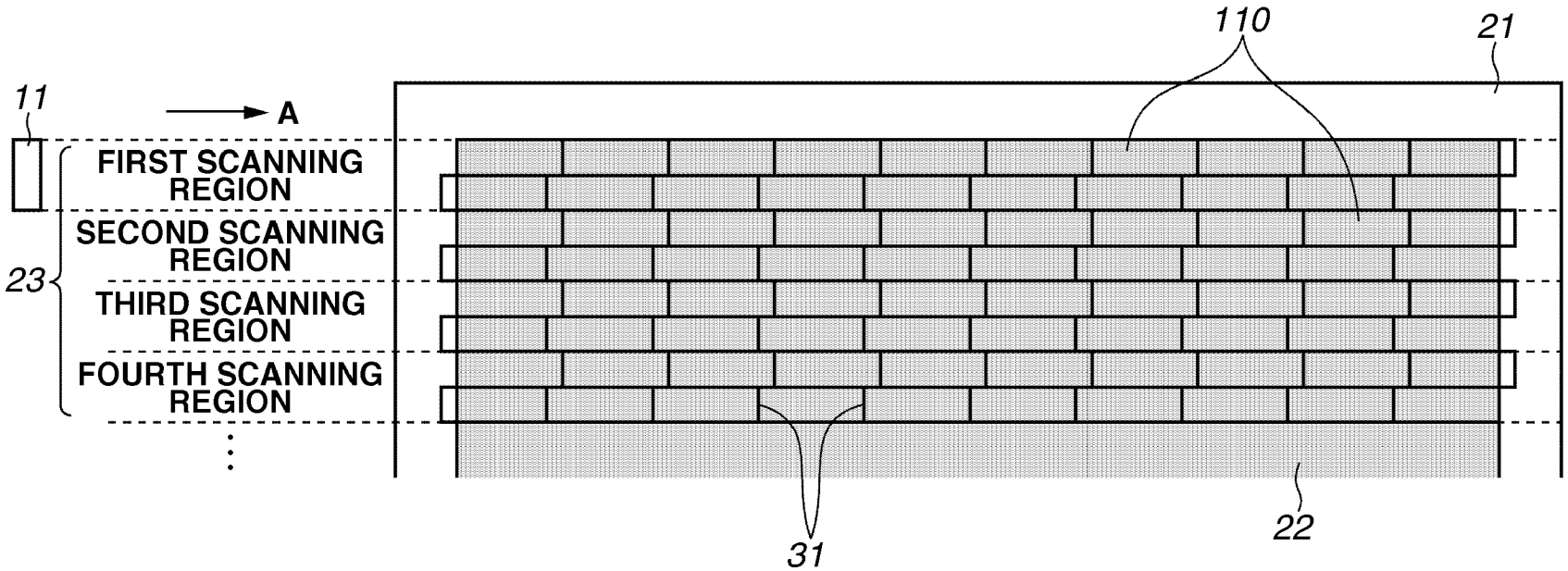
FIG. 9 is a diagram illustrating an example of areas set in a scanning region.

Further, as illustrated in FIG. 9, by setting the value of the number N for dividing along the sub-scanning direction to two or more (in FIG. 9, N=2), the length along the sub-scanning direction of the area boundary lines 31 can be reduced. That is, since the region having a rapidly changing recording density becomes smaller, deterioration in image quality caused by the formation of a region, in which the recording density rapidly changes, can be reduced.

Moreover, the respective exemplary embodiments of the present invention are not limited to a one-pass recording mode, and can be applied to a multipass recording mode. When such a multi-pass recording mode is applied, it is desirable that the correction amount of the recording data for each pass is calculated considering conditions such as the fact that overprinting is performed by printing on the same area several times, and the fact that the recording dot number for each scan is small.

Further, a thinning method called "sequential multi-scan (SMS) thinning processing" can also be used as the correction processing method.

If it is desired to achieve uniform control of the thinning ratio and rapid processing, employing SMS thinning processing is effective. In SMS thinning processing, every time a piece of recording data arrives, its count value (a specific bit, e.g., MSB) designated by a counter (register) is read, and if that value is "1", the recording data is not thinned (recording is performed). On the other hand, if the counter value is "0", the recording data is thinned (recording is not performed). Then, the counter is shifted by a bit to the left (the bit is shifted). When the counter is shifted to the left end, the counter is again returned back to the left end (is cyclically shifted). By repeating this processing every time a piece of recording data arrives, the thinned dots are determined (are subjected to thinning processing).

SMS thinning will now be described in more detail using FIGS. 10A to 10D. In FIGS. 10A to 10D, among the recording data, recording data is represented by a circle, and places with no data to be recorded are represented by a cross. Further, the data to which attention is being paid is illustrated in bold type. Regarding the counter values, places where recording is to be performed are indicated with a 1, and places where the recording data is to be subjected to thinning processing are indicated with a 0. The counter values that are designated by the counter are illustrated in bold type.

In FIG. 10A, the first piece of recording data is a circle, and the counter value is 0, so that the first piece of data is thinned. Therefore, after the processing the first piece of recording data is a cross, and the counter moves one place to the left (FIG. 10B). The next piece of data will not be recorded, so this piece of data remains as a cross, and the counter remains where it is without shifting (FIG. 10C). For the third piece of data, since the counter value is 1, the data remains as it is, and the counter is shifted one bit to the left. Thus, the recording data is thinned by a ratio of one piece in four (FIG. 10D).

Thus, since whether thinning is performed or not is determined only for dots which have recording data, there is no synchronization with the pattern of the recording data. Further, since there is no need to prepare a plurality of mask patterns, this method can definitely be applied for an apparatus in which the mask pattern storage capacity is restricted.

In addition, the dot count processing and the correction processing are not limited to the above-described processing, in which the discharge data is counted from binary recording data, and the correction is performed on the recording data. For example, the recording dot number can be counted from multivalued image data, and the correction processing can be performed by changing the recording dot number in the image data. Dot count processing and correction processing using multivalued image data will be described in more detail below.

In the control block illustrated in FIG. 5, the data conversion unit 618 in the image signal processing unit 604 produces a binary pattern corresponding to gradation values "K" of each pixel of the multivalued image data of an image input from the host apparatus into the image input unit 603 and stored. For example, if multivalued image data represented by 4 bits (16 gradation levels) was input into the image input unit 603, this input data has to be converted into binary data by the data conversion unit 618. Here, the binarization processing of the input image data will be described using a case in which conversion processing by surface area gradation is used.

Figure 11A:
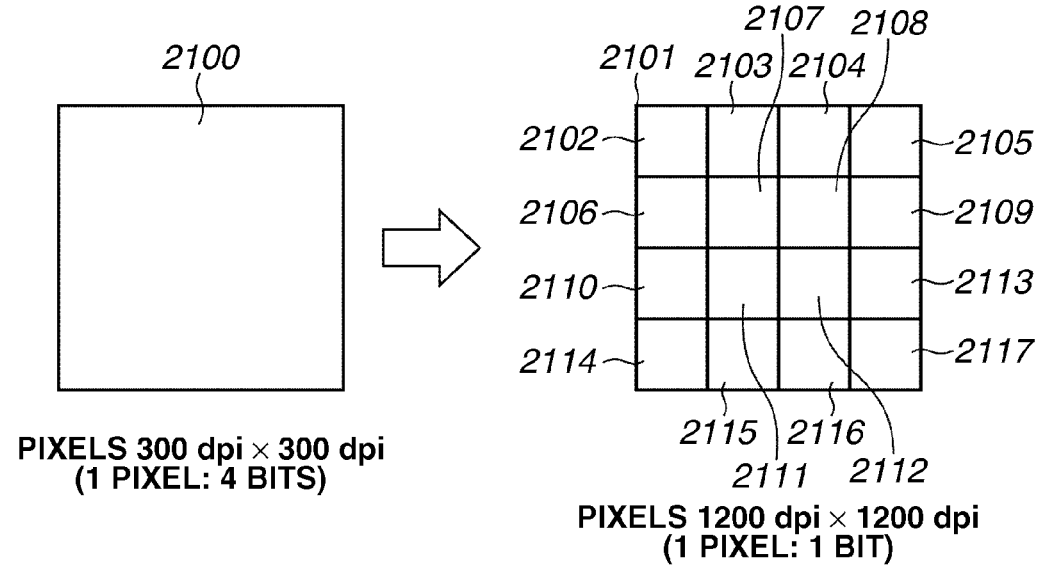
FIGS. 11A and 11B are diagrams illustrating an image processing of multivalued data.

As indicated by image data 2100 illustrated in FIG. 11A, input data having a size for one pixel of (1/300) square inches (resolution 300 dpi×300 dpi) and 4 bits (16 gradation levels) for each of the colors C, M, Y, and K is sent from a host apparatus (not illustrated). Then, first, pseudo-halftone processing and resolution conversion processing, in which, specifically, 4×4 pixels are assigned per one pixel of the input image, are performed for each piece of input data of each color. Next, with this 4×4 pixel lattice as a single unit matrix, processing is performed which replaces the gradation values of 0 to 15 with a dot number of 0 to 15 of discharge data indicated with "1" in the respective unit matrices. As a result, recording data 2101 (2102 to 2117) is produced which corresponds to the original one pixel data 2100, in which one dot is 1/1200 of a inch (1200 dpi×1200 dpi) in both the main scanning direction and the sub-scanning direction, and which has one bit per pixel (2 gradation levels) for each of the CMYK colors. Then, recording is performed based on the thus-produced recording data.

Figure 11B:
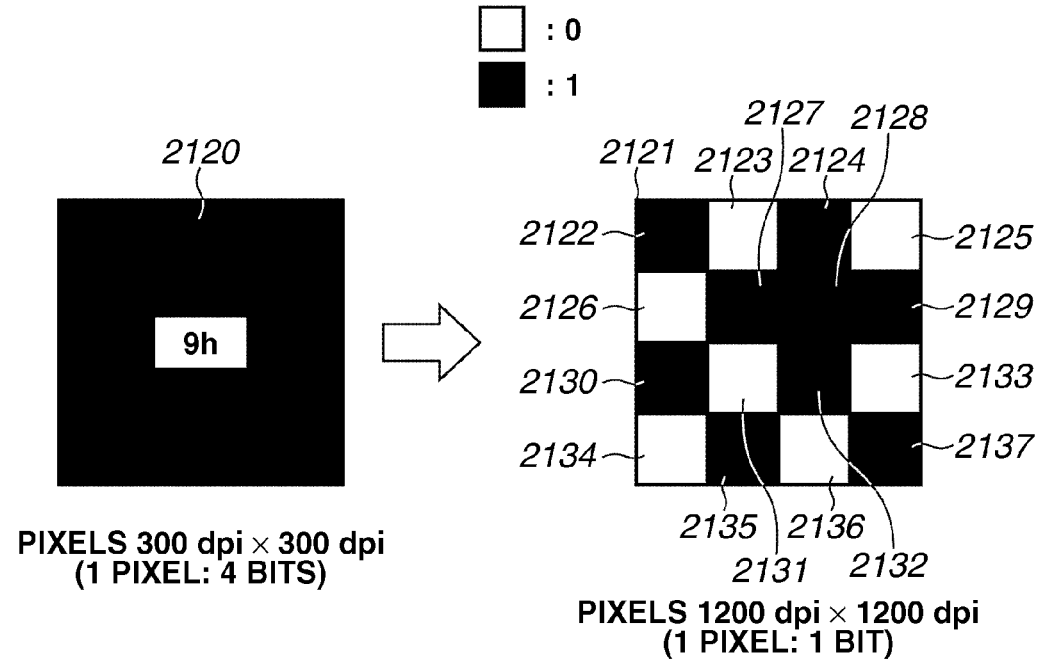

FIG. 11B is a diagram illustrating an example in which pixel data 2120 (resolution 300 dpi×300 dpi) of one pixel (4 bits) having a pixel value "9h" (h represents a base 16 number) sent from the host apparatus is converted into recording data 2121 (2122 to 2137). The converted recording data 2121 includes nine dots (nine "1"s) configured by recording data (dot resolution 1200 dpi×1200 dpi) represented by one bit per pixel. While various techniques have been proposed for pseudo-halftone processing and resolution conversion processing, in the exemplary embodiment the pseudo-halftone processing and the resolution conversion processing are simultaneously performed by a table look-up technique. In this method, recording data (resolution 300 dpi×300 dpi) having four bits per pixel sent from the host apparatus is, according to the value of this recording data, converted into 16 gradation levels using prepared recording data (1200 dpi× 1200 dpi) having one bit per dot. Further, the resolution conversion processing is not limited to using a surface area gradation method for the binarization processing of the input image data. This processing can be performed by any processing method, such as an average density storage method or a dither matrix method.

In the above configuration, the areas 110 are set in the respective scanning regions in order to perform the dot count processing. When the recording head discharge port number is 256, the recording width is 8 inches, and the resolution is 300 dpi×300 dpi, the respective scanning regions have a size of 64 pixels (=256/4) along a sub-scanning direction and of 2400 pixels (=8×300) along a scanning direction length. Therefore, for example, the areas 110 set for the odd-numbered scanning regions are set by dividing up an area setting region, in which the length in the sub-scanning direction is similar to that of the scanning regions and the length in the scanning direction is longer by 100 pixels than the recording width, into N=1 areas in the sub-scanning direction and M=10 areas in the scanning direction. That is, in the odd-numbered scanning regions, the areas 110 are set having a size of 64 pixels in the sub-scanning direction and 250 pixels in the scanning direction.

On the other hand, the areas 110 set for the even-numbered scanning regions are set by dividing up the area setting region, in which the length in the sub-scanning direction and the length in the scanning direction are similar to those of the scanning regions, into N=1 areas in the sub-scanning direction and M=10 areas in the scanning direction. That is, in the odd-numbered scanning regions, the areas 110 are set having a size of 64 pixels in the sub-scanning direction and 240 pixels in the scanning direction. Further, data having a gradation value of from 0 to 15 are allotted to each of the pixels of the areas 110 set in the above manner.

Three pieces of count data, such as a dot count value Et, an integrated dot count value Smt, and a total dot count value Sat, are used in the dot count processing. That is, the discharge number, which is obtained by integrating the multivalued data gradation values of the area (m, n), which is the m-th area from the left edge of the recording region and the n-th area from the top edge of the recording region, which is recorded by an 1-th scan, is given as the dot count value Et (m, n). Further, the integrated dot count value in the 1-th scan is given as the integrated dot count value Smt (m, n), and the total of the integrated discharge numbers from a first scan to the scan one time before is given as the total dot count value Sat (1−1). Further, the correction amount calculated for each area is represented as Ht (m, n).

It is noted that the outline of the dot count processing using the three pieces of count data is similar to that in the first exemplary embodiment described above, and thus a description thereof is not repeated here.

Next, the recording data correction processing technique will be described in more detail. Here, a method, which changes the level of the multivalued gradation values, is employed as the correction method of the image data.

FIG. 12 schematically illustrates multivalued input data in a region of the recording data. The total number of dots in the recording data and the integrated value of the gradation values of the input data meet each other at this stage.

When calculating the correction amount using the above three pieces of count data, first, the numerical value to be reduced as the correction amount from the integrated value of the data gradation values of the input data is calculated. Then, arbitrary image gradation values of the input data are reduced in order by one gradation value. This is repeated until the reduced value corresponds to the correction amount. As the order for reducing the gradation values, the reductions are carried out with priority on higher gradation values.

For example, if the input data 2401 has a pixel number of 64 (300 dpi), an integrated value of the gradation values of 380, and the number to be reduced as the correction amount was calculated to be 30, processing for reducing gradation values of the 30 pixels by one, which are selected in order of higher gradation out of the 64 pixels, is performed. The result after the processing becomes as illustrated in data 2402 in FIG. 12. The numerical values enclosed by bold-type squares represent the pixels whose data was changed.

As described above, correction processing for changing the recording dot number of the image data can be performed by counting the recording dot number from the multivalued image data. Even in this case, by setting the position, in the scanning direction, of the area boundary line 31 to be different from that of the area boundary line 31 of adjacent scanning regions, deterioration in image quality, which is caused by the formation of a region in which recording density suddenly changes, can be reduced.

In the second exemplary embodiment of the present invention, for the portion near the boundary of two areas that are adjacent in the scanning direction, the average of the correction amounts of those two areas is employed. By performing such correction processing, even when the correction amount of those two areas are greatly different, the recording density change at their boundary is reduced, which allows deterioration in image quality to be reduced. It is noted that structures already described in the first exemplary embodiment are denoted by the same reference numerals, and thus a detailed description thereof is not repeated.

Figure 13A:
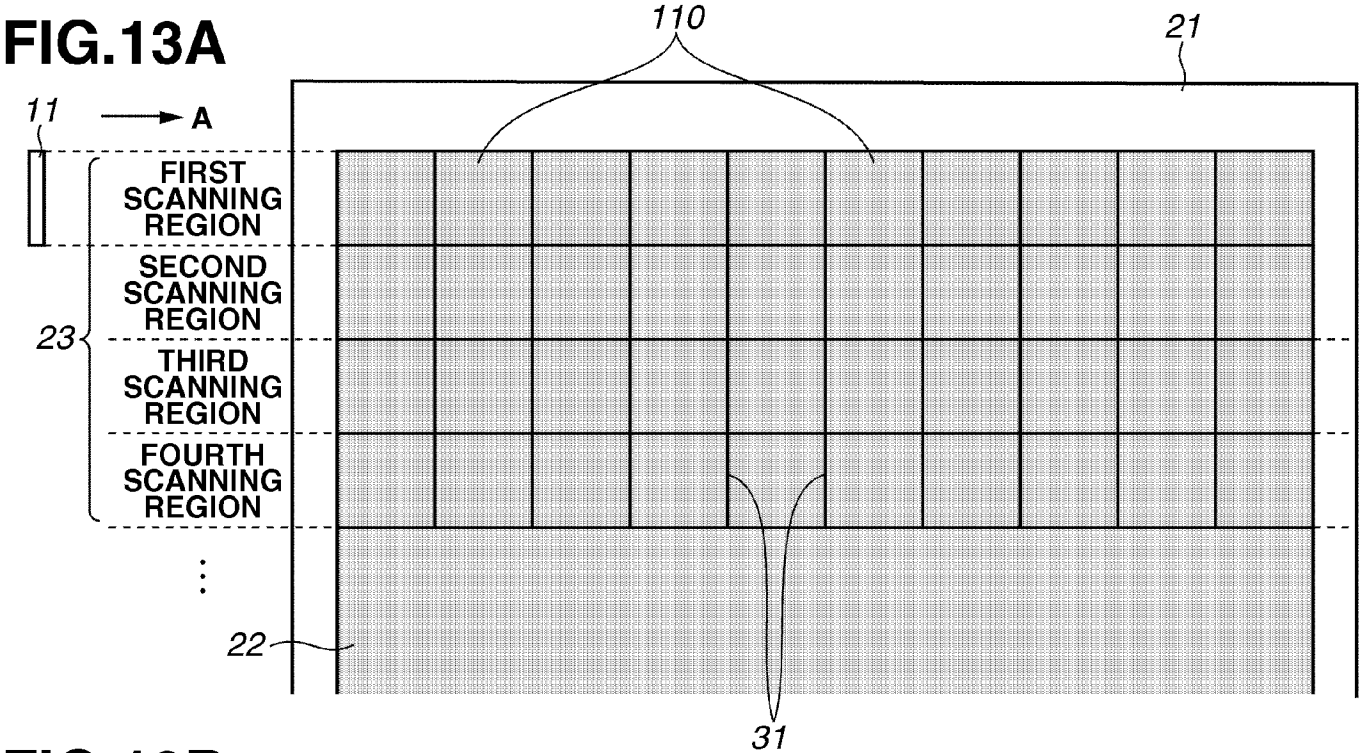
FIGS. 13A and 13B are diagrams illustrating the setting of the areas in a second exemplary embodiment of the present invention.

FIG. 13A is a schematic diagram illustrating the setting of areas 110 in the present exemplary embodiment. In the second exemplary embodiment, the area setting region has a similar size to the scanning regions in the scanning direction and in the sub-scanning direction. Further, the areas 110 are set by dividing this area setting region into N=1 areas in the sub-scanning direction and M=10 areas in the scanning direction. Describing this using specific numbers, the recording width is 8 inches in the present exemplary embodiment, the scanning regions have a length of 256 pixels in the sub-scanning direction, and a recording width of 9600 pixels (=8×1200 dpi). Thus, the areas 110 are set as regions having a size of 256 pixels in the sub-scanning direction and 960 pixels in the scanning direction. However, in the present exemplary embodiment, the area boundary lines 31 are not provided in a position different in the scanning direction from that of adjacent scanning regions.

Next, dot count processing is performed on the thus-set areas 110, to calculate the correction amount for each area based on the dot count results. The dot count processing of the present exemplary embodiment, similar to that in the first exemplary embodiment, uses the three pieces of count data, a dot count value E, an integrated dot count value Sm, and a total dot count value Sa. Further, the calculation of the correction amount H is also performed in a similar manner to the first exemplary embodiment, based on the above three pieces of count data. Therefore, a detailed description of the dot count processing and the correction amount calculation is not repeated.

Figure 13B:
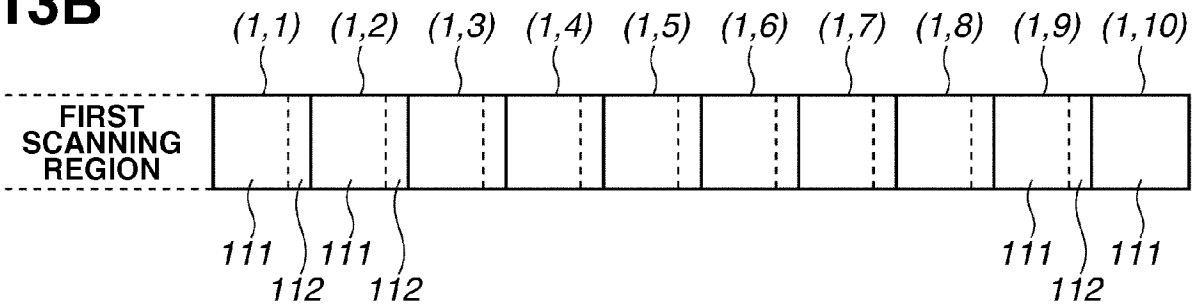

Next, each of the areas 110 is divided into a normal region, in which the thus-determined correction amount is employed without modification, and a proximal region, in which the average (averaged correction amount) of the correction amounts of the two areas adjacent to each other in the scanning direction is employed to reduce the recording density change. FIG. 13B is a schematic diagram illustrating, in the present exemplary embodiment, normal regions 111 and proximal regions 112 defined in each of the areas 110 of the first scanning region to be recorded by the first scan. As illustrated in FIG. 13B, excluding the area (1, 10) of the right edge of the 1st scanning region, normal regions and proximal regions are set for from area (1, 1) to (1, 9). These normal regions are set as regions of the left side 950 pixels of the areas 110, and the proximal regions are set as regions of the right side 50 pixels in the areas 110. The whole area (1, 10) of the right edge of the scanning region is set as a normal region.

Further, in the normal regions of areas (1, 1) to (1, 10), the correction amounts H (1, 1) to H (1, 10), which are calculated based on the three pieces of count data, are employed without modification. On the other hand, in the proximal regions of areas (1, 1) to (1, 9), average correction amounts H' (1, 1) to H' (1, 9), each of which is an averaged amount of the correction amounts of the two areas adjacent to each other in the scanning direction, are employed. Here, the average correction amounts H' (1, n) employed in the proximal regions of areas (1, n) are calculated according to numerical expression (2) illustrated below.

$$H'(1, n)=\{H(1, n)+H(1, n+1)\}/2 \quad (2)$$

For example, the average correction amount H' (1, 1) employed in the proximal region of area (1, 1) is calculated as an average value of the average correction amount H (1, 1) of area (1, 1) and the average correction amount H (1, 2) of area (1, 2).

To reduce recording density changes caused by an increase in the temperature of the recording head, as the recording head advances in the scanning direction, the correction amount for each area tends to increase. For that reason, for example, for areas (1, 1) and (1, 2), correction is performed with the correction amount (thinning ratio) to increase in the order of the correction amounts of the normal region of area (1, 1), the correction amount of the proximal region of area (1, 1), and the correction amount of the normal region of area (1, 2).

Thus, the ratio (correction ratio) of the number of dots to be reduced with respect to the total dot number in each region is calculated based on the correction amounts calculated in the normal regions and the proximal regions. Further, the thinning processing for reducing to a desired recording dot number is performed by preparing a mask pattern which matches the size of the respective normal region and proximal region, and selecting the mask pattern having the closest correction ratio. It is noted that in addition to a correction processing method using a mask, the correction processing for reducing the recording dot number can be performed by correction processing which uses SMS thinning processing.

Therefore, according to the present exemplary embodiment, density unevenness in the scanning direction due to an increase in the ink discharge amount can be reduced, and deterioration in image quality can be reduced, because even if a region, in which recording density suddenly changes, is formed, that recording density change can be reduced.

Further, methods for reducing recording density changes are not limited to the above-described recording method. For example, 50 pixels on the left side and the right side of an area boundary line 31, for a total of 100 pixels, can be set as a proximal region. Further, the size of this proximal region can be set to be capable of reducing the recording density change at the boundary between areas. Moreover, the correction amount for the proximal region can be calculated by performing processing which subtracts a fixed value from a value calculated by adding the correction amounts of two adjacent areas. That is, the correction amount for a proximal region can be a value between the correction amounts of two adjacent areas.

In the above description, the area boundary lines 31 are not provided in positions different in the scanning direction for adjacent scanning regions. However, like in the first exemplary embodiment, the areas 110 can also be set so that the position of the area boundary line 31 in the scanning direction between areas 110 which are adjacent in the scanning direction is different from that of the area boundary line 31 of scanning regions adjacent in the sub-scanning direction. In such a case, because the area boundary lines 31 are not continuous in the sub-scanning direction at the same position in the scanning direction, deterioration in image quality can be further reduced.

Among inkjet recording systems, the present invention has especially excellent effects in recording heads and recording apparatuses including a unit for producing thermal energy for causing a state change of the ink and discharging ink (e.g., an electrothermal transducer).

Regarding the representative configuration and principles of such a system, it is effective to use the basic principles described in U.S. Pat. Nos. 4,723,129 and 4,740,796. This system can be applied to either on-demand type or continuous type systems. In the case of an on-demand type system, at least one drive signal, which corresponds to the recording information and which applies a sudden temperature increase to exceed nucleate boiling, is applied to an electrothermal transducer provided in positions corresponding to the positions of a sheet or a liquid flow path where a fluid (ink) is held. Thus, thermal energy is generated in the electrothermal transducer, so that film boiling occurs on the thermally active surface of the recording head. As a result, since bubbles in the fluid (ink) can be formed in a one-to-one correspondence with this drive signal, the system is more effective for an on-demand type system. Due to the growth and contraction of these bubbles, fluid (ink) is discharged via an opening for discharge, whereby at least one droplet is formed. If this drive signal is formed in a pulse shape, since the growth and contraction of the bubbles occur immediately and suitably, fluid (ink) discharge can be achieved with especially excellent responsiveness. As such a pulse-shaped drive signal, the signals described in U.S. Pat. Nos. 4,463,359 and 4,345,262 are suitable. Further, better recording can be performed by employing the conditions described in U.S. Pat. No. 4,313,124, which relates to the rate of increase in the temperature of the thermally active surface.

As the configuration of the recording head, the present invention is not limited to the configurations described in the above patent documents which combine discharge ports, liquid flow paths (straight liquid flow paths or orthogonal liquid flow paths), and an electrothermal transducer. For example, configurations discussed in U.S. Pat. Nos. 4,558,333 and 4,459,600, in which a thermally active unit is arranged in a curved region, are also included in the scope of the present invention. In addition, a configuration discussed in Japanese Patent Application Laid-Open No. 59-123670, in which slits common to a plurality of electrothermal transducers are used as the discharge units of the electrothermal transducers, is effective. Further, the a configuration discussed in Japanese Patent Application Laid-Open No. 59-138461, in which openings for absorbing thermal energy pressure waves each corresponds to each of the discharge units. Namely, according to the present invention, recording can be performed reliably and efficiently regardless of the type of the recording head.

In addition, the present invention is effective for above-described serial types, for recording heads fixed to the apparatus body, or for a chip type recording head to be replaceable on the apparatus body and to which electric connection with the apparatus body and ink supply from the apparatus body can be performed by mounting on the apparatus body. The present invention is also effective in the case that uses a cartridge type recording head, in which an ink tank is integrally provided in the recording head. Further, the recording apparatus according to the exemplary embodiments of the present invention can be additionally provided with a discharge recovery unit of the recording head, a preliminary auxiliary unit and the like. For example, the recording apparatus can be additionally provided, to the recording head, with such as a capping unit, a cleaning unit, a pressurization or suction unit, a preliminary heating unit including an electrothermal transducer, some other heating element, or a combination thereof, and a preliminary discharge unit for performing discharge for other than recording to the recording apparatus.

Further, regarding the types and the number of the mounted recording heads, for example, only one corresponding to a single color ink can be provided, or a plurality of recording heads, respectively corresponding to a plurality of inks of different colors or different densities, can be provided. Namely, for example, the recording head can be integrally configured or formed with a combination of a plurality of recording heads, other than the recording mode of the recording apparatus using only a mainstream color such as black. However, the present invention is also effective in apparatuses that include at least one of a multicolor recording mode of different colors or a full color recording mode by mixing colors. In addition, in the above-described exemplary embodiments, while the ink is described as a liquid, the ink can be solid at below room temperature, which softens or liquefies at room temperature. In an inkjet system, it is common to control the temperature so that the viscosity of the ink is in a stable discharge range by adjusting the temperature of the ink to be within a range of approximately 30° C. to 70° C. Therefore, ink, which turns into a liquid when a signal for recording is applied, can also be used. Further, to prevent an increase in temperature caused by thermal energy, thermal energy can be used as energy for changing the ink state from solid state to liquid state, and to prevent evaporation of the ink, ink that solidifies without heating and liquefies by heating can also be used. In any case, the present invention can also be applied to a case where an ink having a quality of liquefying when the thermal energy is application. Such types of inks includes an ink which liquefies when thermal energy is applied according to a recording signal so that a liquid ink is discharged, or an ink which has already solidified by the time it reaches the recording medium. Such inks can be held in a liquid state or as a solid in the concave portions of a porous sheet or in through-holes, and positioned to face an electrothermal transducer, as described in Japanese Patent Application Laid-Open Nos. 54-56847 or 60-71260. In the present invention, the film boiling system is most effective for the above-described inks.

Further examples of the inkjet recording apparatus include a type to be used as an image output terminal of an information processing machine such as a computer, a copying machine combined with a reader, and a facsimile machine having a sending and receiving function.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-017839 filed Jan. 29, 2008, which is hereby incorporated by reference herein in its entirety.

What is claimed is:

1. A recording apparatus for recording an image on a recording medium by scanning the recording medium with a recording head for discharging ink, the recording apparatus comprising:

a thinning unit configured to thin data for discharging ink by the recording head on a plurality of areas formed by dividing set regions, including at least a first set region and second set region, corresponding to scanning regions to be recorded each by one scan of the recording head in a scan direction; and a recording head drive unit configured to discharge ink by driving the recording head based on data which has been thinned by the thinning unit, wherein a boundary between areas of the first set region is located at a different position in the scan direction from that of a boundary between areas of the second set region, which is adjacent to the first set region in a direction crossing the scan direction, and, wherein the set regions have a shorter length than that of the scanning regions in a direction orthogonal to the scan direction.

2. The recording apparatus according to claim 1, wherein the set regions have a longer length than that of the scanning regions in the scan direction.

3. The recording apparatus according to claim 1, wherein the recording head comprises a heater configured to generate thermal energy for discharging ink.

4. A recording apparatus for recording an image on a recording medium by scanning the recording medium with a recording head for discharging ink, the recording apparatus comprising:

a determination unit configured to determine a thinning ratio of data for discharging ink on a plurality of areas, including at least a first area and a second area, formed by dividing scanning regions to be recorded each by one scan of the recording head in the scan direction for a proximal portion of a boundary between the first area and the second area, which are adjacent in the scanning direction, for the first area excluding the proximal portion, and for the second area excluding the proximal portion;

a thinning unit configured to thin data based on the thinning ratio determined by the determination unit; and a recording head drive unit configured to discharge ink by driving the recording head based on data which has been thinned by the thinning unit, wherein the thinning ratio of the proximal portion is an average value of the thinning ratio of the first area and the thinning ratio of the second area.

5. A method for recording an image on a recording medium by scanning the recording medium with a recording head for discharging ink, the method comprising:

thinning data for discharging ink by the recording head on a plurality of areas formed by dividing set regions, including at least a first set region and second set region, corresponding to scanning regions to be recorded each by one scan of the recording head in a scan direction; and discharging ink by driving the recording head based on the thinned data, wherein a boundary between areas of the first set region is located at a different position in the scan direction from that of a boundary between areas of the second set region, which is adjacent to the first set region in a direction crossing the scan direction, and, wherein the set regions have a shorter length than that of the scanning regions in a direction orthogonal to the scan direction.

6. The method according to claim 5, wherein the set regions have a longer length than that of the scanning regions in the scan direction.

7. The method according to claim 5, further comprising generating thermal energy for discharging ink.

8. A method for recording an image on a recording medium by scanning the recording medium with a recording head for discharging ink, the method comprising:

determining a thinning ratio of data for discharging ink on a plurality of areas, including at least a first area and a second area, formed by dividing scanning regions to be recorded each by one scan of the recording head in a scan direction for a proximal portion of a boundary between the first area and the second area, which are adjacent in the scanning direction, for the first area excluding the proximal portion, and for the second area excluding the proximal portion;

thinning data based on the thinning ratio; and discharging ink by driving the recording head based on the thinned data, wherein the thinning ratio of the proximal portion is an average value of the thinning ratio of the first area and the thinning ratio of the second area.

* * * * *